US010537168B1

(12) United States Patent
Littleton

(10) Patent No.: US 10,537,168 B1
(45) Date of Patent: Jan. 21, 2020

(54) TRAVELER LEATHER TUMBLER SLEEVE

(71) Applicant: Colonel Littleton Ltd., Inc., Lynnville, TN (US)

(72) Inventor: Garry A. Littleton, Lynnville, TN (US)

(73) Assignee: Colonel Littleton Ltd., Inc., Lynnville, TN (US)

( * ) Notice: Subject to any disclaimer, the term of this patent is extended or adjusted under 35 U.S.C. 154(b) by 0 days.

(21) Appl. No.: 16/387,399

(22) Filed: Apr. 17, 2019

Related U.S. Application Data

(60) Provisional application No. 62/659,113, filed on Apr. 17, 2018.

(51) Int. Cl.
*A45F 5/10* (2006.01)

(52) U.S. Cl.
CPC ..... *A45F 5/10* (2013.01); *A45F 2200/0583* (2013.01)

(58) Field of Classification Search
CPC ..... A45F 3/16; A45F 5/10; A45F 2005/1006; A45F 2005/1013; A45F 2200/0583; B65D 81/3876; B65D 81/3881; B65D 23/108
USPC ..... 294/27.1, 31.2, 149; 224/148.4, 148.5, 224/148.6; 220/739; 215/396, 397; D7/624.2
See application file for complete search history.

(56) References Cited

U.S. PATENT DOCUMENTS 4,540,611 A * 9/1985 Henderson ..... B65D 23/08 150/901
6,290,091 B1 * 9/2001 Bell ..... B65D 81/3876 220/739
D474,887 S * 5/2003 Forster ..... D3/229
7,510,157 B2 * 3/2009 Oliver ..... A45C 13/28 220/739
D739,240 S * 9/2015 Satterfield ..... D7/396.2
9,480,353 B1 * 11/2016 Chuang ..... A47G 23/0216
D778,597 S * 2/2017 Lynch ..... D3/229
2002/0145295 A1 * 10/2002 Frank ..... B65D 25/22 294/31.2
2006/0037982 A1 * 2/2006 Lesser ..... A45F 5/00 224/148.4

(Continued)

OTHER PUBLICATIONS

Application No. 29698642 filed Jul. 18, 2019 for Leather Tumbler Sleeve and claims priority to Application No. 16387399.

(Continued)

*Primary Examiner* — Dean J Kramer
(74) *Attorney, Agent, or Firm* — Waller Lansden Dortch & Davis LLP; Matthew C. Cox

(57) ABSTRACT

A tumbler sleeve for holding a beverage container includes a first panel, a second panel, and a third panel. The first panel and the second panel are coupled along lateral edges to form a sleeve. The third panel is coupled to the first panel. The sleeve may form an upper opening and a lower opening. The upper opening is configured to receive a beverage container. The interior surface of the sleeve is configured to engage the beverage container in an interference fit when the beverage container is received by the sleeve. A handle is coupled to the sleeve in a pivoting engagement such that a user may hold the tumbler sleeve while maintaining the beverage container upright. The lower opening allows the lower end of a beverage container to directly contact a surface.

12 Claims, 21 Drawing Sheets

(56) References Cited

U.S. PATENT DOCUMENTS

| | | | | |
|---|---|---|---|---|
| 2007/0138217 | A1* | 6/2007 | Hranilovich | A45F 5/00 224/148.6 |
| 2009/0126149 | A1* | 5/2009 | Whittaker | B65D 81/3879 16/111.1 |
| 2011/0192859 | A1* | 8/2011 | Belford | B65D 81/3876 220/739 |
| 2014/0021730 | A1* | 1/2014 | Miwa | A47G 23/0216 294/27.1 |

OTHER PUBLICATIONS

Application No. 29698645 filed Jul. 18, 2019 for Leather Tumbler Sleeve and claims priority to Application No. 16387399.

* cited by examiner

TRAVELER LEATHER TUMBLER SLEEVE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application is a non-provisional of U.S. Patent Application No. 62/659,113 filed Apr. 17, 2018 entitled TRAVELER LEATHER TUMBLER SLEEVE, which is hereby incorporated by reference in its entireties.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to apparatuses for holding and insulating beverage containers.

Beverage containers are generally useful for carrying beverages and reducing waste from disposable beverages containers. Some beverage containers are even suited to insulate the beverage in order to maintain the temperature of the beverage for extended periods of time. Holders are known and are used in connection with beverage containers. For example, drink carriers may provide the multiple receptacles for carrying a plurality of beverage containers. The difficulty with these containers is they have a loose fitting, are heavy, are difficult to handle, and are not well balanced.

Other holders may provide a sock into which a beverage may be inserted. However, these holders are not easy to handle as the beverage holder must be gripped by a user with an empty or free hand. Such holders do not provide a solution to providing a better or improved grip on beverage containers.

What is needed then are improvements to apparatuses for holding and handling beverage containers.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the disclosure is a tumbler sleeve for holding a beverage container, having a first panel, a second panel, and a third panel. The first panel and the second panel may be coupled along lateral edges to form a sleeve. The third panel may be coupled to the first panel. The sleeve may form an upper opening and a lower opening. The upper opening may be configured to receive a beverage container. The interior surface of the sleeve may be configured to engage the beverage container in an interference fit when the beverage container is received by the sleeve.

Another aspect of the disclosure is a tumbler sleeve for holding a beverage container, including a first panel having a first anterior surface, a first posterior surface, a first lateral edge, and a second lateral edge, a second panel having a second anterior surface, a second posterior surface, a third lateral edge coupled to the first lateral edge of the first panel, and a fourth lateral edge coupled to the second lateral edge of the first panel such that the first panel and second panel form a sleeve having an upper end and a lower end. The tumbler sleeve may further comprise a third panel with a first end and a second end, wherein the third panel is coupled to the first panel.

Another aspect of the disclosure includes a tumbler sleeve apparatus for holding a beverage container, including a first panel having a first anterior surface, a first posterior surface, a first lateral edge, and a second lateral edge. The tumbler sleeve apparatus may further comprise a second panel having a second anterior surface, a second posterior surface, a third lateral edge coupled to the first lateral edge of the first panel, and a fourth lateral edge coupled to the second lateral edge of the first panel such that the first panel and second panel form a sleeve having an upper end and a lower end. The tumbler sleeve apparatus may further comprise a third panel having a first end and a second end, the third panel coupled to the first panel. The tumbler sleeve apparatus may further comprise a handle coupled to the upper end of the sleeve in a rotatable engagement, wherein the sleeve forms an upper opening configured to receive the beverage container, and wherein the handle is configured to span the upper opening when the beverage container is received by the sleeve.

Another aspect of the disclosure includes a drinking apparatus, including a beverage container having an outer surface, an upper container end, and a lower container end and a beverage container sleeve having a first panel and a second panel coupled at lateral ends of the first and second panels and a third panel coupled to the first panel and extending around the first and second panels. In some embodiments the first panel and the second panel form an interior receiver with an open upper end and an open lower end. Furthermore, the beverage container may be positioned in the beverage container sleeve. The upper container end may also extend out of the open upper end of the beverage container sleeve and the lower container end may extend out of the open lower end of the beverage container sleeve.

Numerous other objects, advantages and features of the present disclosure will be readily apparent to those of skill in the art upon a review of the following drawings and description of a preferred embodiment.

DETAILED DESCRIPTION

Figure 1:
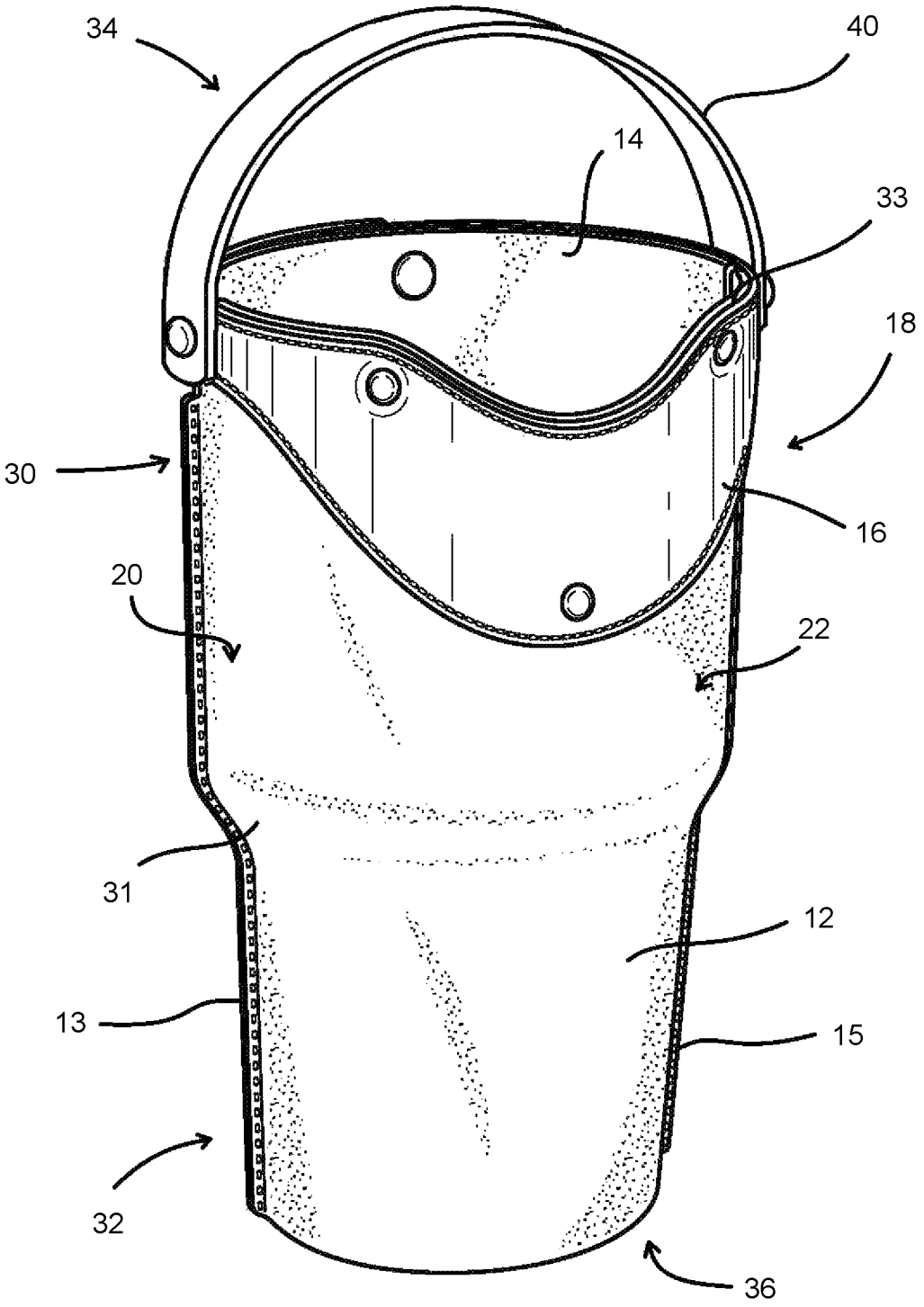
FIG. 1 is a perspective view an exemplary embodiment of a tumbler sleeve having a handle disposed above the tumbler sleeve.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

An embodiment of a tumbler sleeve 18 is shown in FIG. 1. The tumbler sleeve apparatus 18 includes a first panel 12, a second panel 14 (seen in FIGS. 1 and 2), and a third panel 16. The first panel 12 has a first lateral edge 20 and a second lateral edge 22 and the second panel 14 has a third lateral edge 24 coupled to the first lateral edge 20 of the first panel 12 forming a first seam 13, and a fourth lateral edge 26 coupled to the second lateral edge 22 of the first panel 12 forming a second seam 15 such that the first panel 12 and second panel 14 form a sleeve 18 having an upper end 30 and a lower end 32. The sleeve 18 forms an upper opening 34 and a lower opening 36. In alternative embodiments, the sleeve 18 may only form a single upper opening 34. In the embodiment shown, a ridge 31 is formed in the first and second panels 12, 14 such that the diameter of the upper end 30 is greater than the diameter of the lower end 32. Likewise, the sleeve 18 may generally include a tapered profile from the upper end 30 and narrowing toward the lower end 32.

With further reference to FIG. 1, third panel 16 is coupled to the first panel 12 at the upper end 30 of the sleeve 18. The third panel 16 may be permanently coupled to the first panel 12 or, in alternative embodiments, may be removably coupled to the first panel 12. Although one of skill in the art may determine alternative means for coupling the third panel 16 to the first panel 12, FIG. 1 demonstrates a riveted engagement. Other methods of coupling may include sewing, glue, buttons, a zip fastener, and any other fastener or engagement available to one of skill in the art. The upper edge 33 of the third panel 16 may be fashioned to match the profile of the upper edge of the first panel 12. Thus, when the third panel 16 is installed on the first panel 12, the upper edges align and form a single profile. In some embodiments, the upper profile of the first and third panels 12, 16 include a recess 60, which will be discussed hereafter.

Figure 2:
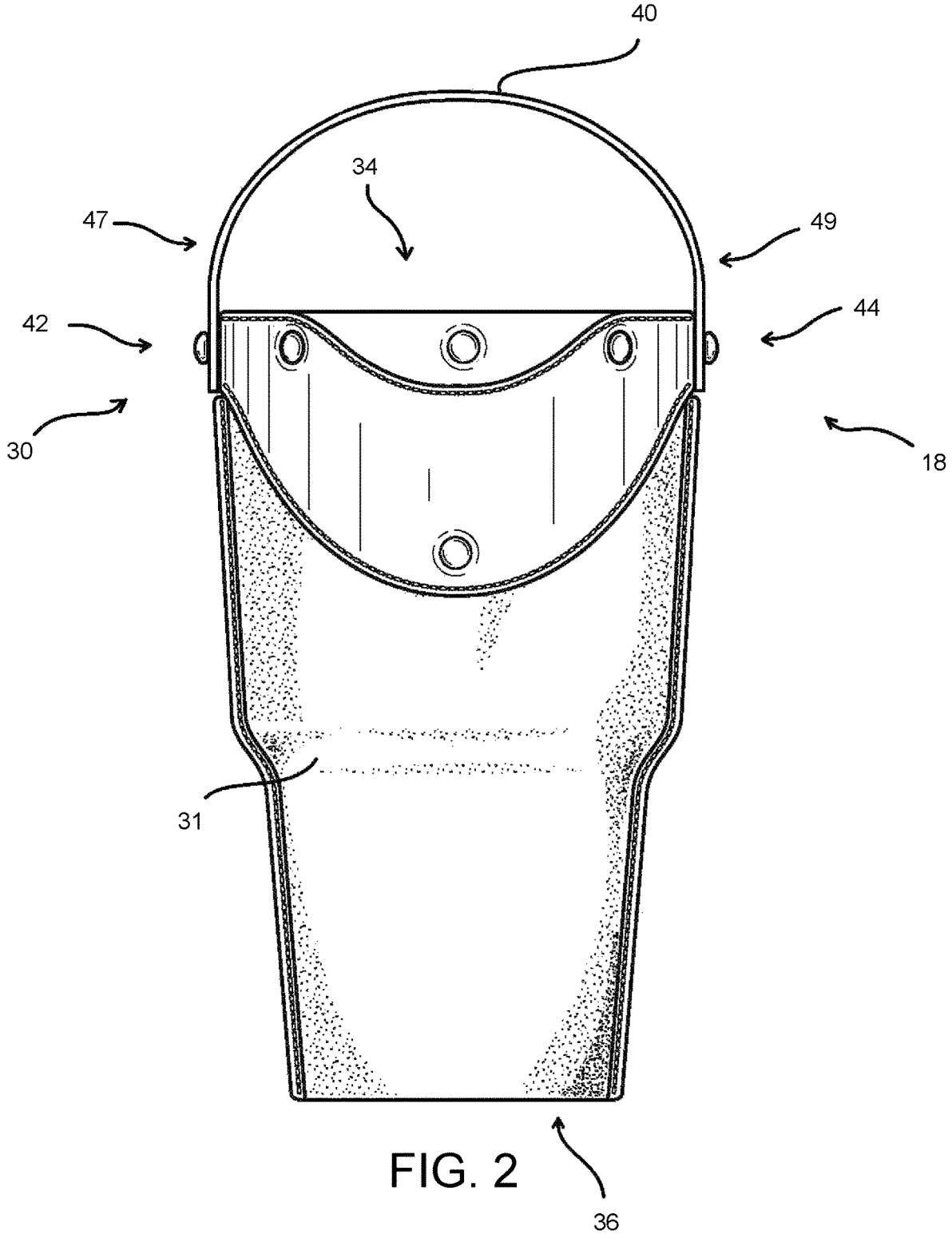
FIG. 2 is a front view of an exemplary embodiment of a tumbler sleeve having a handle disposed above the tumbler sleeve.

Referring now to FIG. 2, the tumbler sleeve 18 may include in some embodiments a handle 40. The handle 40 may be coupled to the upper end 30 of the sleeve 18 in a rotatable engagement. In some embodiments, the handle 40 is configured to span the upper opening 34 of the sleeve 18, both when the tumbler (or beverage container) is received by the sleeve 18 or when the sleeve 18 is empty. The handle 40 is configured to couple to the sleeve 18 at a first coupling position 42 and a second coupling position 44. The first coupling position 42 is opposite the second coupling position 44 relative to the upper opening 34. Thus, the first coupling position 42 is opposite the second coupling position 44 across the upper opening 34.

The first coupling position 42 and second coupling position 44 are located on the upper end 30 of the sleeve 18 such that when a tumbler is received by the tumbler sleeve 18 and positioned upright, the first coupling position 42, the second coupling position 44, and the handle 40 are above the center of gravity of the tumbler. This allows the handle 40 to be grasped by a user such that the first position 42 and second position 44 remain above the center of gravity of the tumbler and the liquid is contained within the tumbler. The handle 40 may be formed such that a user may easily and conveniently grasp the handle 40 with a single finger, allowing the user to maintain use of that hand. This can be especially useful when a user is attempting to carry multiple items such as keys, umbrellas, books, briefcases, computers, phones, or any other object. The positioning of the handle 40 provides the ability to carry a tumbler with one finger, keeping the tumbler upright.

Figure 3:
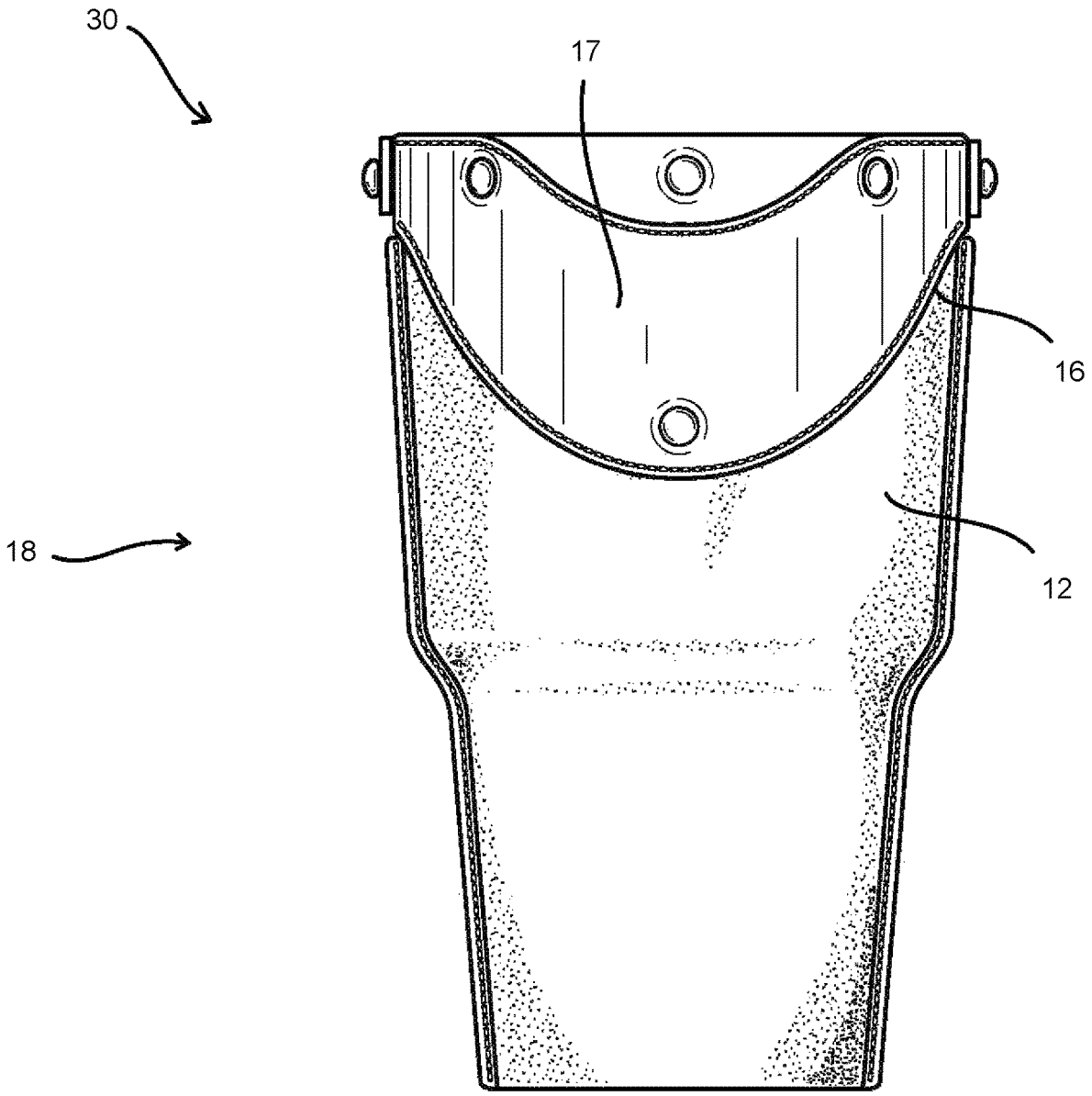
FIG. 3 is a front view of an exemplary embodiment of a tumbler sleeve having a handle rotated away from an upper opening of the tumbler sleeve.

With further reference to FIGS. 1-3, the handle 40 is coupled to the sleeve 18 such that the handle 40 is rotatable relative to the sleeve 18 at the first coupling position 42 and the second coupling position 44. Thus, the handle 40 may be rotated such that the handle 40 does not obstruct the upper opening 34 during insertion or removal of the tumbler 50 (or beverage container) from the sleeve 18. In some embodiments, the handle 40 is dimensioned such that when the handle 40 is rotated away from the upper opening 34, the bottom surface 45 of the handle 40 slides onto and sits substantially flush with either the first, second, or third panel 12, 14, 16. Thus, the handle 40 may be rotated away from the upper opening 34 and maintained in a position such that the profile of the sleeve 18 is substantially retained. Other embodiments provide a handle 40 that is slightly longer than half of the outer circumference of the upper end 30 of the sleeve 18. This allows the handle 40 to rotate away from the upper opening 34 and rotate down past at least portions of the third panel 16.

In some embodiments, the bottom surface 45 of the handle 40 may include a gripping texture. The gripping texture may allow the bottom surface 45 of the handle 40 to contact the sleeve 18 and to be retained in the desired position relative to the sleeve 18 when the handle 40 is rotated away from the upper opening 34 (see FIG. 5*c*). This may be advantageous during the insertion, removal, or use of apparatus 10. Some of these advantages may include that when a user is drinking from a tumbler installed in the sleeve 18, the handle 40 is retained against the sleeve 18 while the apparatus 10 is inverted. This prevents the handle 40 from rotating and contacting the user during the inversion or from rotating down during the process of inversion to interfere with the drinking process. Likewise, the textured surface of the bottom surface 45 on the handle may provide enhanced traction for a user when handling the apparatus 10. The textured surface may be accomplished in a variety of ways and will be readily recognized by one of skill in the art. In one embodiment, the handle 40 may be a leather strap and the bottom surface 45 may be an untreated, unfinished, raw, textured, or roughed up surface of the leather strap. However, the apparatus 10 is not limited to any single material or combinations of materials, and one of ordinary skill in the art will recognize that a variety of materials and manufacturing techniques may be used with regards to the present disclosure.

Figure 4:
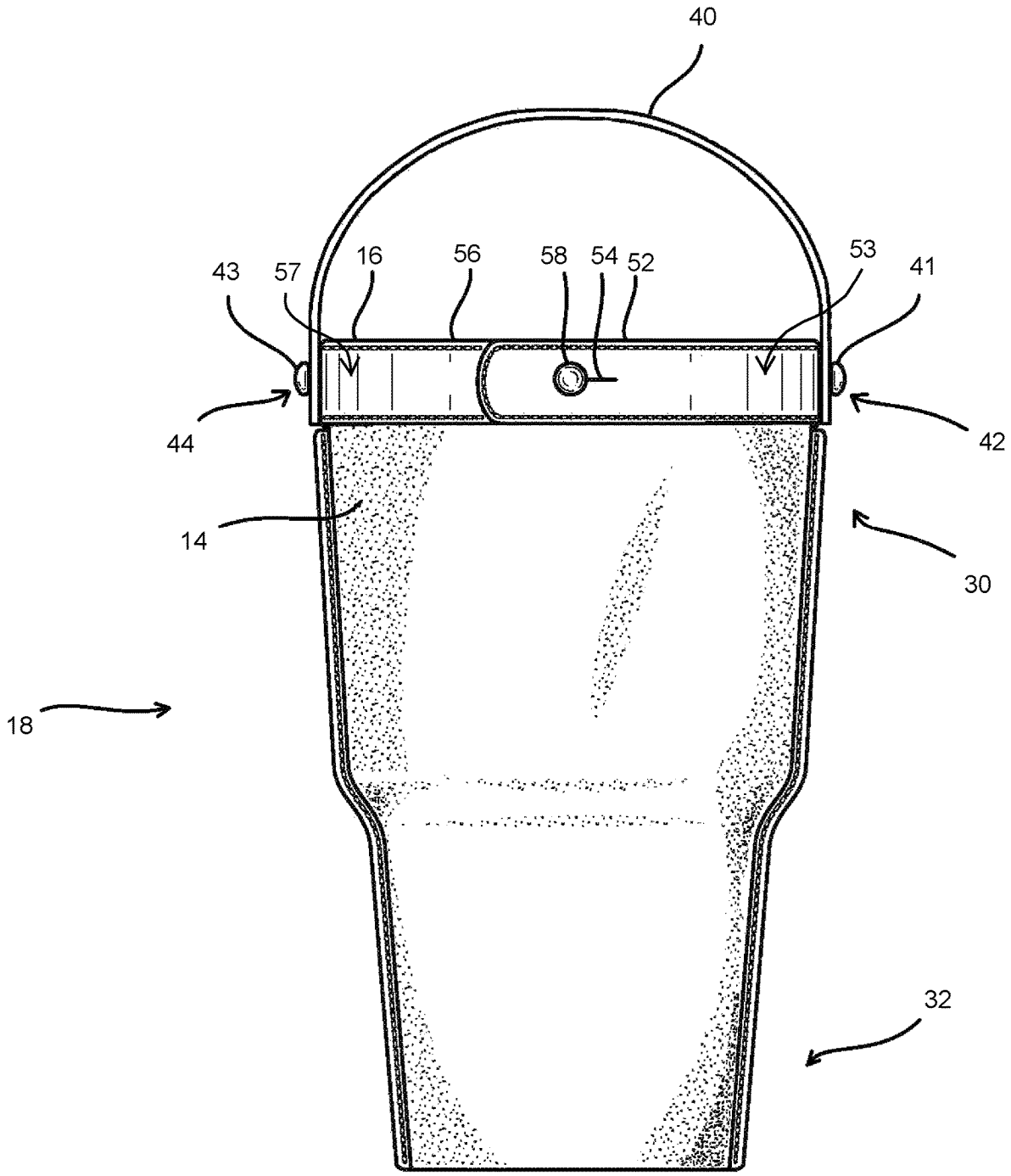
FIG. 4 is a back view of an exemplary embodiment of a tumbler sleeve having a handle disposed above the tumbler sleeve, wherein the first and second extensions of a third panel are demonstrated.
Figure 5A:
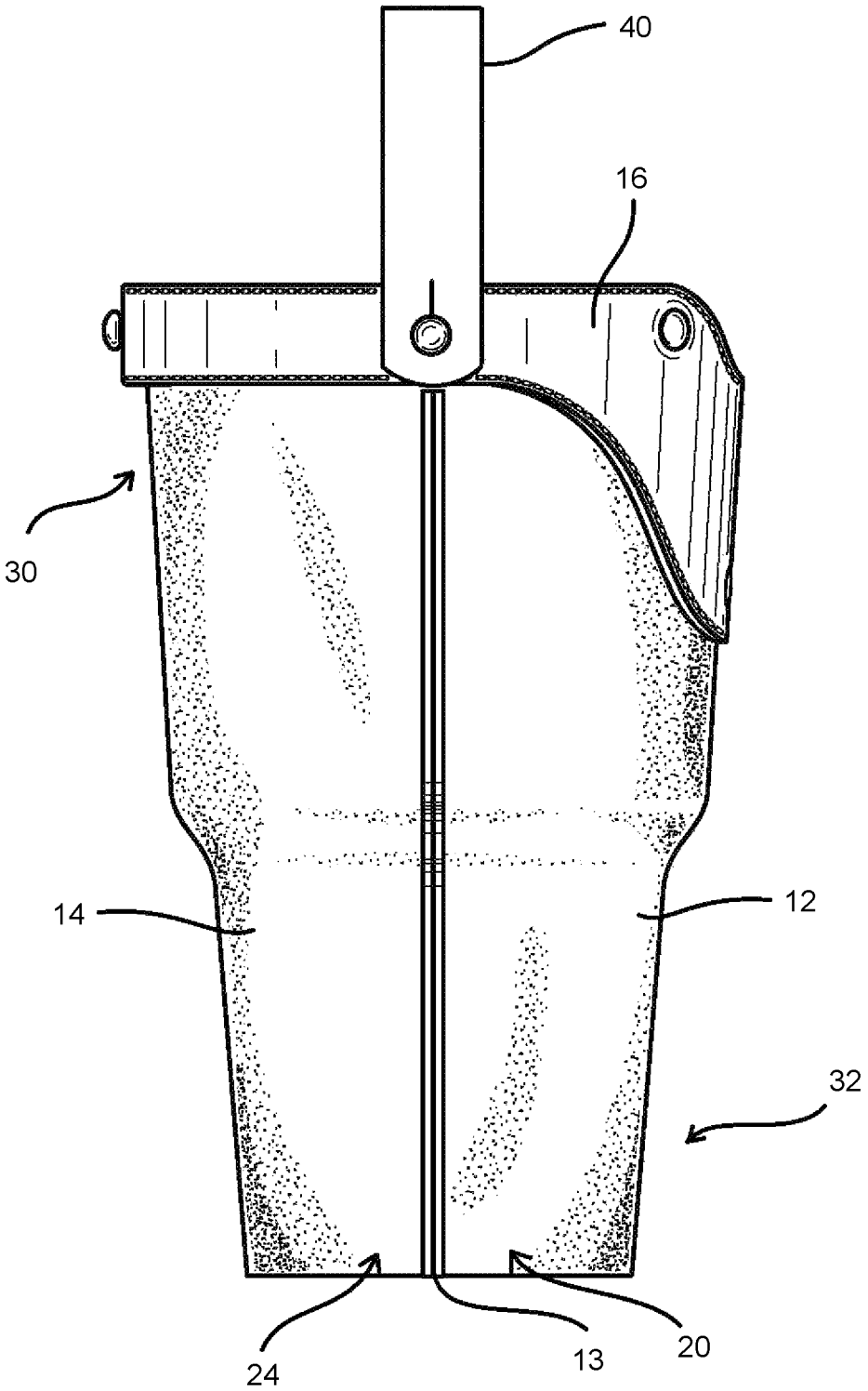
FIGS. 5*a* and 5*b* are side views of an exemplary embodiment of a tumbler sleeve.
Figure 5B:
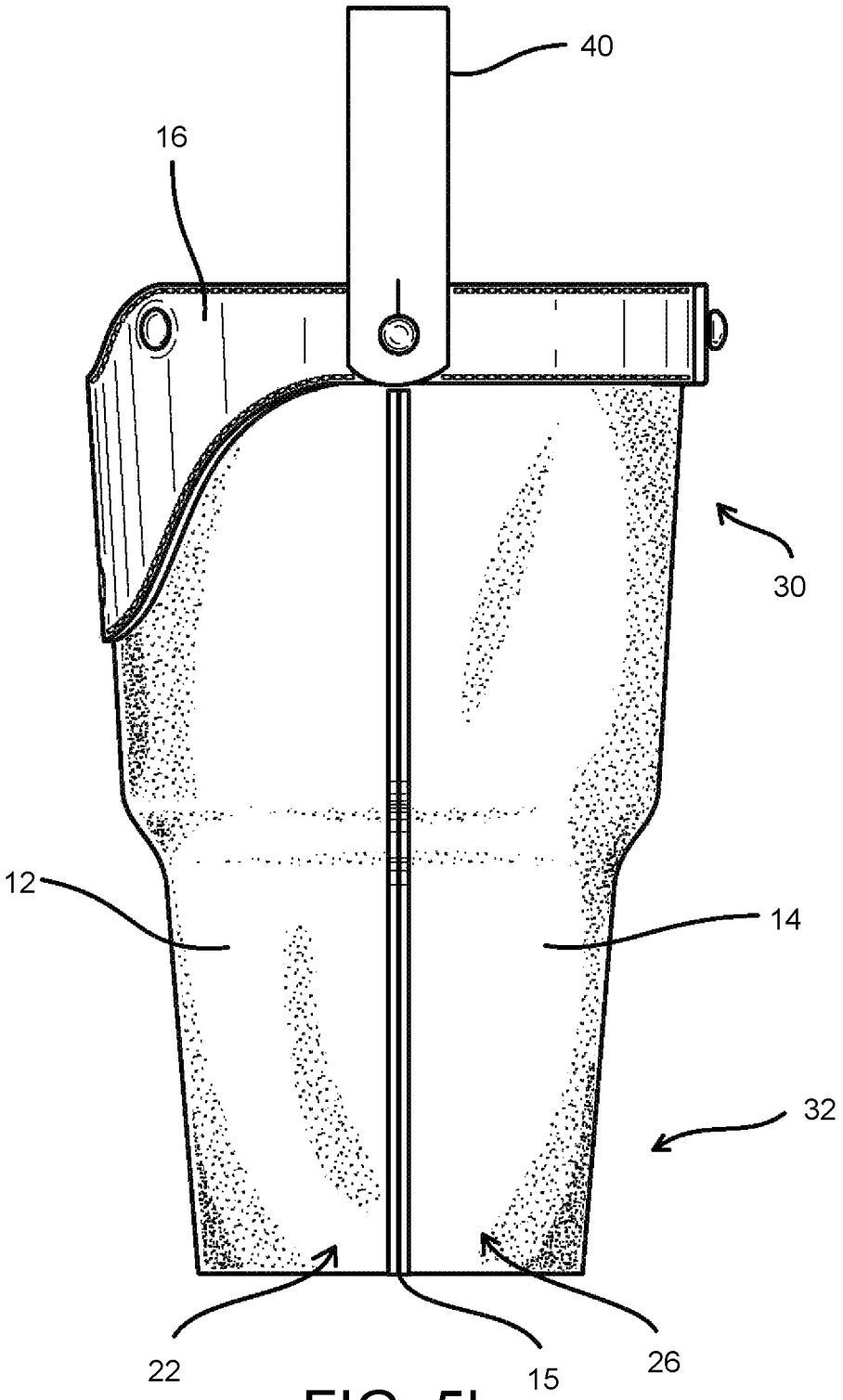
Figure 5C:
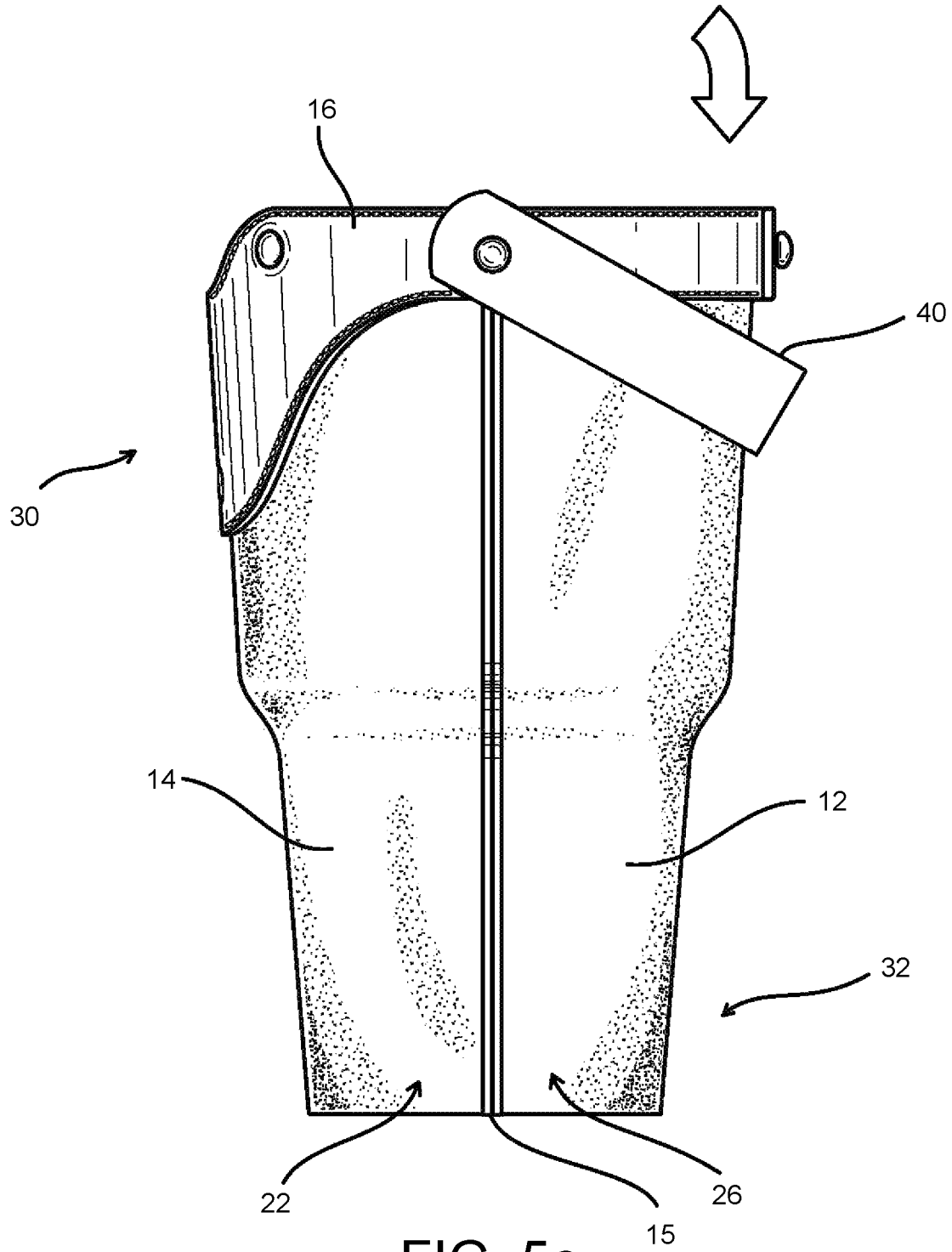
FIG. 5*c* is a side view of an exemplary embodiment of a tumbler sleeve having a handle rotated away from the upper opening of the tumbler sleeve.

Now referring to FIGS. 4-5*c*, the handle 40 may be coupled to the sleeve 18 in a pivoting engagement. As demonstrated in FIG. 4, the handle 40 is coupled to the sleeve 18 via a slit-and-ball engagement. This engagement provides a slit in a portion of material and a ball, which is configured to pass through the slit. This type of engagement allows the handle 40 to pivot about an axis (as seen in FIG. 5*c*). This type of engagement further provides for the removability of the handle 40 from the sleeve 18. The pivoting engagement may also be accomplished via various fasteners as is known by one of skill in the art.

Still referring to FIG. 4, the handle 40 may include a first end 47 and a second end 49. The sleeve 18 may include a first side ball fastener 41 and a second side ball fastener 43. The first side ball fastener 41 may be positioned on the sleeve 18 at the first coupling position 42 and the second side ball fastener 43 may be positioned at the second coupling position 44. The handle 40 may be removable and rotatably coupled to at the first coupling position 42 via the first end 47 of the handle 40 coupled to the first side ball fastener 41 and at the second coupling position 44 via the second end 49 of the handle 40 coupled to the second side ball fastener 43.

In some embodiments, the first position 42 of the engagement between the handle 40 and the sleeve 18 may be proximate the first lateral edge 20 near a first seam 13 between the first panel 12 and the second panel 14. In other embodiments, the first position 42 of the engagement between the handle 40 and the sleeve 18 may be at the first seam 13 between the first panel 12 and the second panel 14. In other alternative embodiments, the first position of the engagement between the handle 40 and the sleeve 18 may proximate the upper end 30 of the sleeve 18. The first position 42 of the engagement between the handle 40 and the sleeve 18 may be proximate the first lateral edge 20 near a first seam 13 between the first panel 12 and the second panel 14. In these various embodiments, the second position 44 of the engagement between the handle 40 and the sleeve 18 may be at or proximate the second seam 15 between the first panel 12 and the second panel 14, or the second position 44 of the engagement between the handle 40 and the sleeve 18 may be on the upper end 30 of the sleeve 18.

Referring to FIGS. 4-5*c*, the engagement between the handle 40 and the sleeve 18 may extend through the third panel 16. In some embodiments, because the engagement is a ball-and-slit engagement, the third panel 16 may also have an additional slit that allows the third panel 16 to be removed from the ball-and-slit engagement. In other embodiments, the third panel 16 is permanently fastened to the sleeve 18 via the engagement between the handle 40 and the sleeve 18. In another embodiment, the engagement between the handle 40 and the sleeve 18 does not extend through the third panel 16 such that the third panel 16 does not contact the fasteners 41, 43.

Now turning to the various figures of the present disclosure depicting a third panel 16, the third panel 16 as previously discussed may be coupled to the first panel 12. The third panel 16 may include portions that extend from a body 17 of the third panel 16. As can be seen in FIGS. 3 and 4, the portions may include a first extension 53 and a second extension 57. The first extension 53 and the second extension 57 may extend such that third panel 16 wraps around the outer circumference of the upper end 30 of the sleeve 18. In one embodiment, the third panel 16 may be permanently coupled to the first panel 12. In alternative embodiments, the third panel 16 may be coupled in a removable engagement such that third panel 16 may be loose or third panel 16 may be fastened around the first and second panels 12, 14.

In some embodiments, the first extension 53 and the second extension 57 may be fastened in a ball-and-slit engagement. A first end 52 of the first extension 53 of the third panel 16 may have a first slit 54 and a second end 56 of the second extension 57 of the third panel 16 may have a ball fastener 58. Thus, when the first extension 53 with the first end 52 extends around a first portion of the sleeve 18 and the second extension 57 with the second end 56 extends around a second portion of the sleeve 18, the ball 58 of the second end 56 may pass through the slit 54 of the first end 52. Because the slit 54 retains the ball 58 in position, the third panel 16 and its ends 52, 56 are retained in position. The length of the third panel 16 and the positions of the slit 54 and ball 58 on the third panel 16 may provide extra support for and traction against the tumbler when the tumbler is positioned in the tumbler sleeve 18. Tension may be maintained across the third panel 16 when the first end 52 and second end 56 of the third panel 16 are coupled. It is within the scope of this disclosure to include any other fasteners known to one of skill in the art, including hook and loop fasteners, buckles, clips, buttons, etc.

In an alternative embodiment, the ball fastener 58 may be fastened on the second panel 14. In this embodiment, the first and second ends 52, 56 of the third panel 16 may have a slits. The first slit 54 on the first end 52 and the second slit on the second end 56 may both be operable to couple to the ball fastener 58 of the second panel 14. In this embodiment, the first and second end 52, 56 are retained by the ball 58 and thus remain consistently positioned relative to the second panel 14 when coupled to the ball 58. In an alternative embodiment, the second end 56 of the third panel 16 is permanently coupled to the second panel 14 by the ball fastener 58. This allows the first end 52 of the third panel 16 to be secured to the second end 56 of the third panel 16 and the second panel 14 via the ball fastener 58. The third panel 16 may be operable to provide further support to the first and second panels 12, 14 to prevent the stretching and deforming of those panels through use. Thus, the third panel 16 may be operable to provide enhanced traction of beverage containers placed in the sleeve 18 and to reinforce the sleeve 18 itself.

FIG. 4 provides an exemplary embodiment of portions of a third panel 16. The third panel 16 may extend around the sleeve 18 at an upper end 30 of the sleeve 18. The third panel may provide additional engagement between the tumbler sleeve 18 and the tumbler 50 such that the tumbler does not disengage from the tumbler sleeve 18. The third panel 16 may be coupled to the sleeve 18 in either a permanent or removable engagement, as previously discussed. The third panel 16 may extend around the outer diameter of the sleeve 18 at an upper end 30. As previously mentioned, the third panel may couple to itself at a first end 52 and a second end 56 of the third panel 16. In some embodiments, the first end 52 and the second end 56 of the third panel 16 may be reduced to a position via a fastener or engagement extending from the sleeve 18. However, in some embodiments, the third panel 16 may not extend around the outer diameter of the sleeve 18 at the upper end 30 with a coupling of the first end 52 and the second end 56 of the third panel 16. In these embodiments, the third panel 16 may extend around the outer diameter of the sleeve 18 at any position along the sleeve 18, or alternatively, the third panel 16 directly engages the tumbler 50 by extending around the outer diameter of the tumbler 50, wherein the first end 52 and the second end 56 of the third panel 16 are removably coupled.

Figure 8:
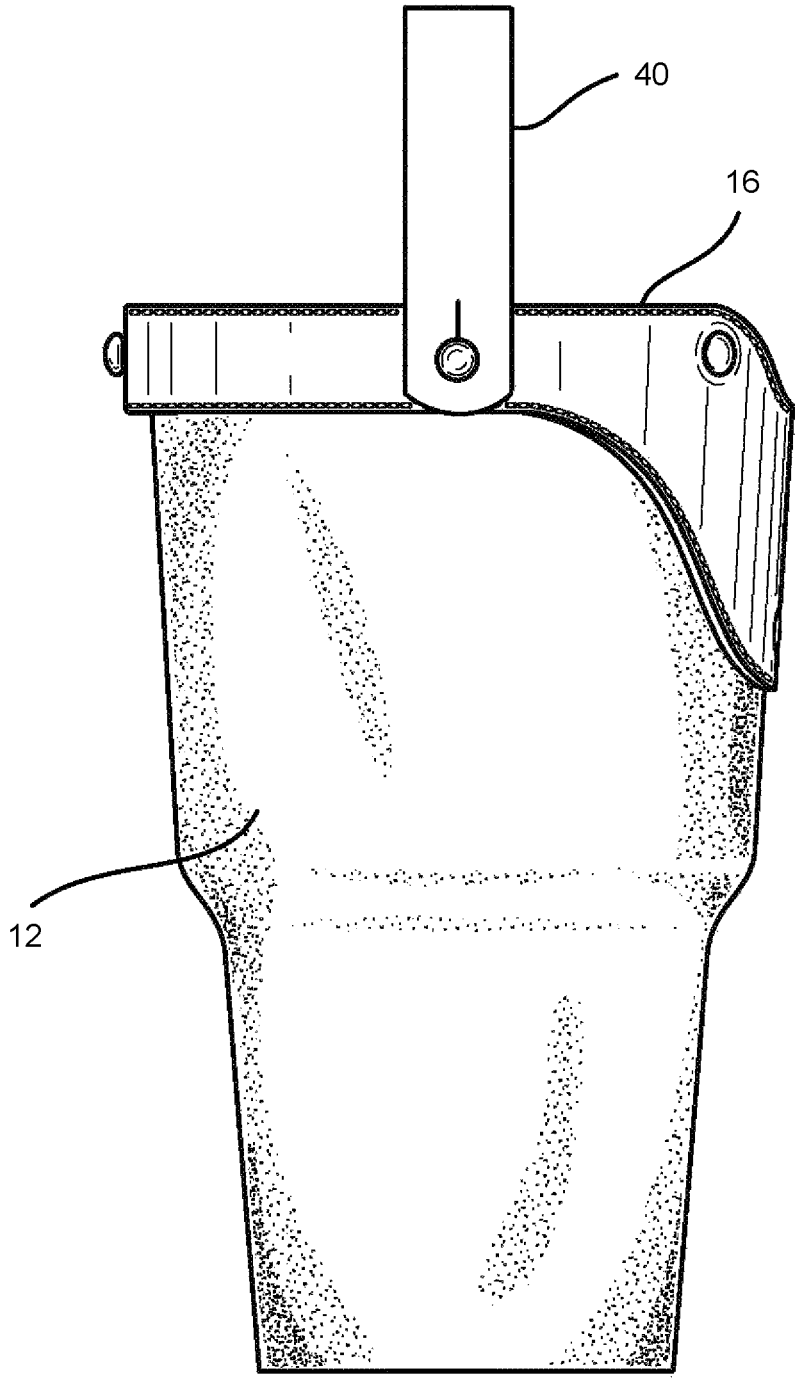
FIG. 8 is a side view of an exemplary alternative embodiment of a tumbler sleeve, wherein the sleeve is formed from a single, first panel.

In alternate embodiments, referring to FIG. 8, the sleeve 18 may comprise a single panel having a single seam (not shown in FIG. 8) at which a first lateral end of the single panel is coupled to a second lateral end of the single panel. Thus, the first panel 12 may be coupled to itself at opposite ends of the first panel 12. The first and second side ball fasteners 41, 43 may be coupled to the sleeve 18 at the seam and across the sleeve 18 from the seam. In alternative embodiments, the first and second side ball fasteners 41, 43 may protrude through the first panel 12, the second panel 14, and/or the third panel 16.

Figure 6:
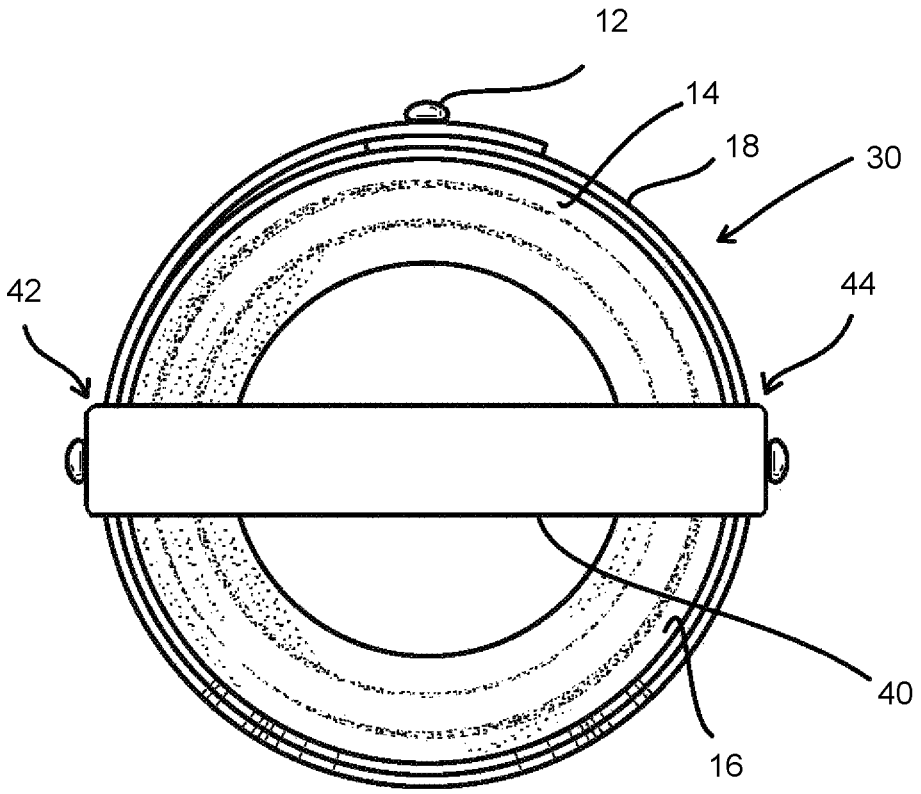
FIG. 6 is top view of an exemplary embodiment of a tumbler sleeve having an upper opening.
Figure 7:
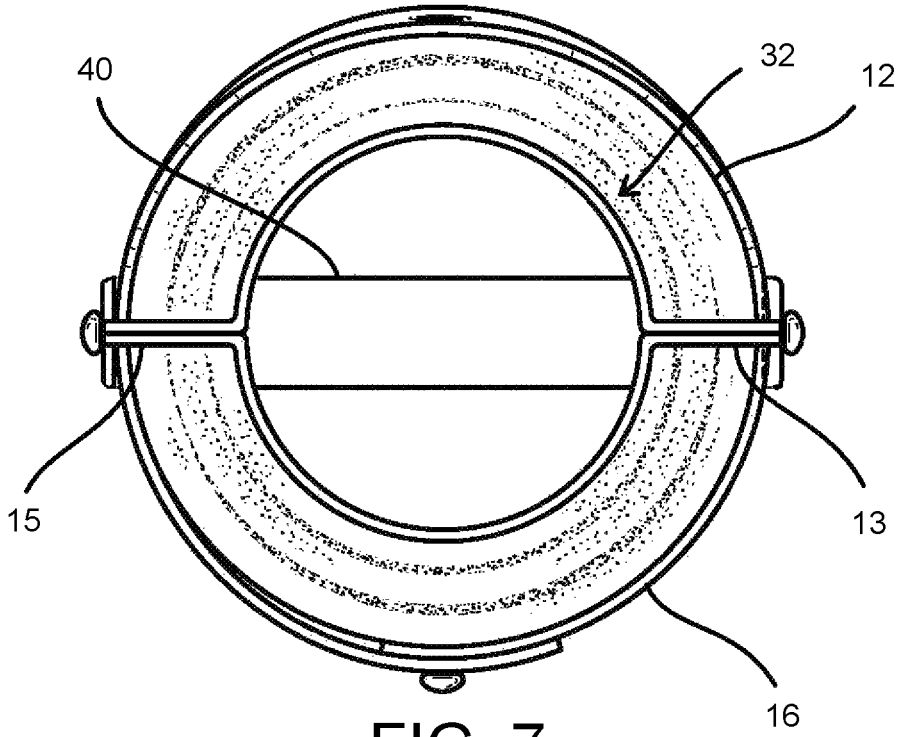
FIG. 7 is bottom view of an exemplary embodiment of a tumbler sleeve having a lower opening.

Referring now to FIGS. 6 and 7, aerial views of an embodiment of the sleeve 18 are demonstrated. As can be seen, the sleeve 18 forms a hollow, interior receiver. The interior receiver is operably to receive a tumbler 50 into the interior of the sleeve. The sleeve 18 may include an upper end 30 and a lower end 32. The upper end 30 may be open in order to receive the tumbler 50. In some embodiments the lower end 32 may likewise be open, as will be discussed hereafter with reference to FIGS. 11 and 12.

Figure 9:
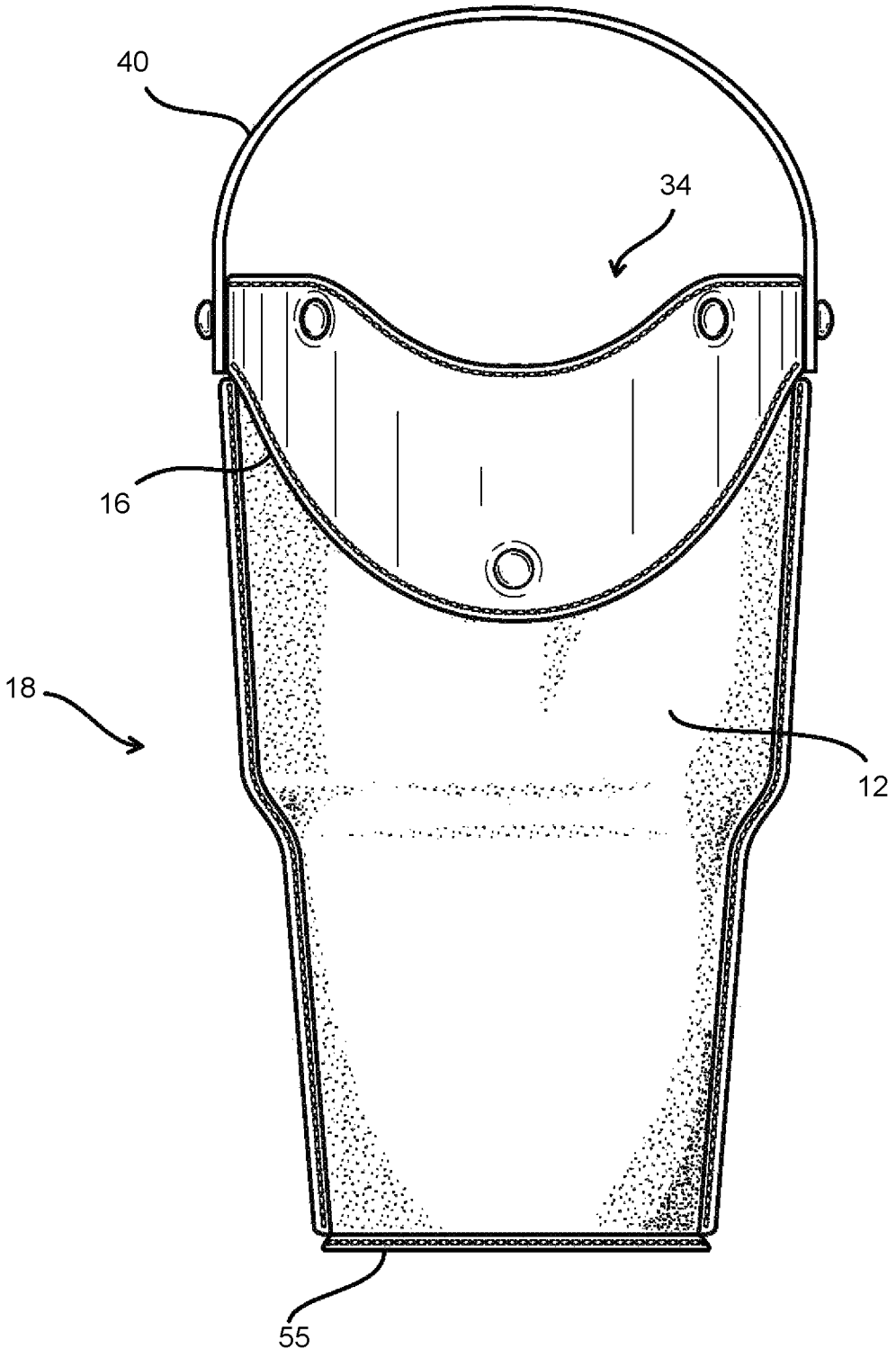
FIG. 9 is a front view of an exemplary alternative embodiment of a tumbler sleeve having two recesses at the upper end of the tumbler sleeve.

In an alternative embodiment, as seen in FIG. 9, a fourth panel 55 may be coupled to the lower edges of the first and second panels 12, 14, or in those embodiments implementing only a single panel, to the lower edge of the first panel 12. An alternative iteration of this embodiment may include the lower edges of the first and second panels 12, 14 being coupled, or in those embodiments with a single panel, the lower edge of the first panel couple to itself.

Further referencing FIG. 9, the first lateral edge 20 of the first panel 12, and a third lateral edge 24 of the second panel 14 may be coupled or joined at a seam. The seam may extend a portion of the length of the first lateral edge 20 and the third lateral edge 24. In some embodiments, the first lateral edge 20 and the third lateral edge 24 are free at the upper end 30 of the sleeve 18 and the first lateral edge 20 and the third lateral edge 24 at the lower end 32 of the sleeve 18 are coupled. This allows the upper end to flare open to receive the tumbler into the open end 34 of the sleeve 18. The third panel 16 provides a clamping action or force at the upper end of the sleeve 18 when the first end 52 and the second end 56 are coupled. In other embodiments, the first lateral edge 20 and the third lateral edge 24 may be coupled at a first seam 13 such that the seam extends the length of the first lateral edge 20 and the third lateral edge 24. Likewise, a second seam 15 may extend a portion of the length of the second lateral edge 22 and the fourth lateral edge 26. In some embodiments, the second lateral edge 22 and the fourth lateral edge 26 are free at the upper end 30 of the sleeve 18 and the second lateral edge 22 and the fourth lateral edge 26 at the lower end 32 of the sleeve 18 when they are coupled.

Figure 11:
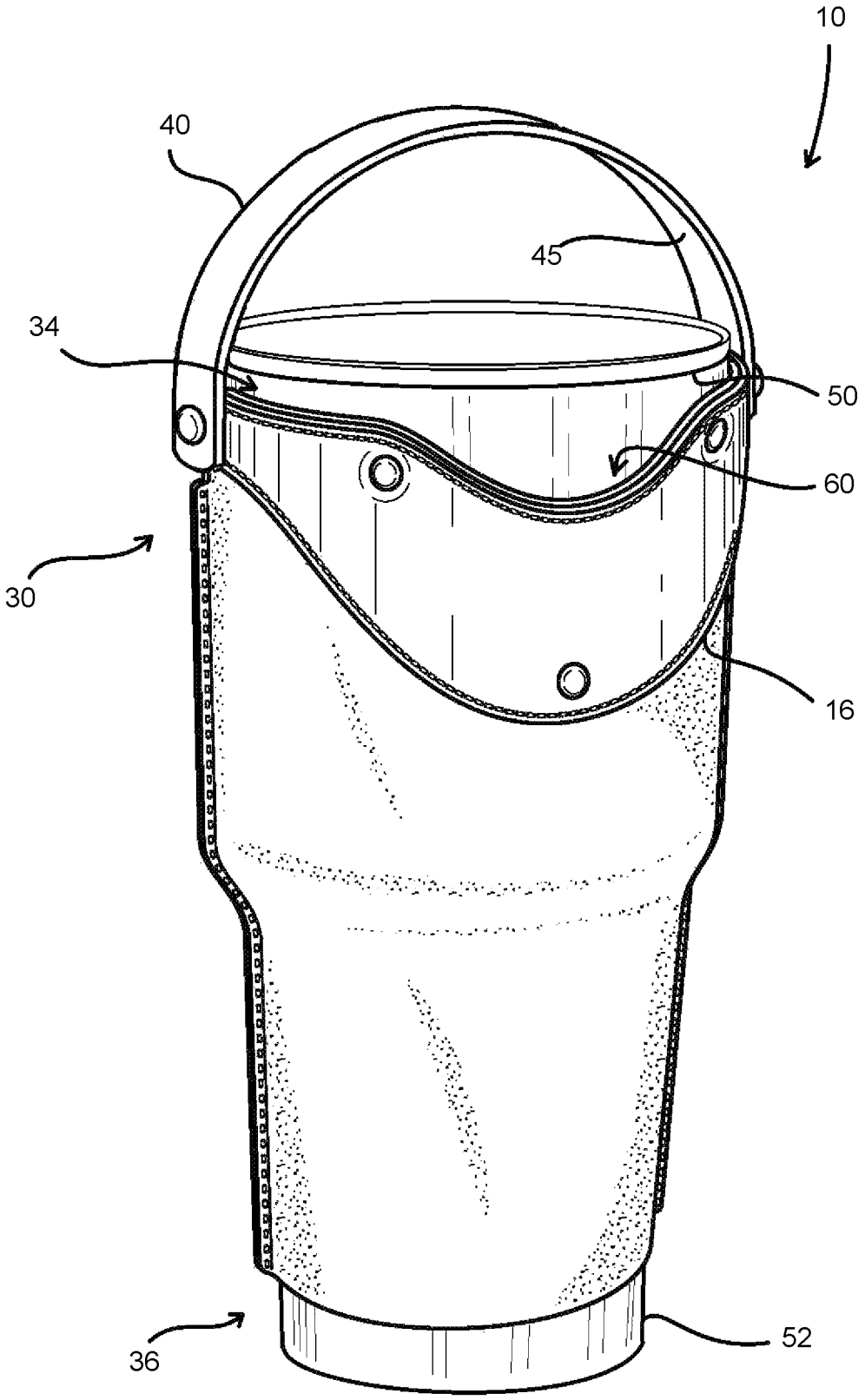
FIG. 11 is a perspective view of an exemplary embodiment of a tumbler apparatus having a beverage container or tumbler positioned in a tumbler sleeve.
Figure 12:
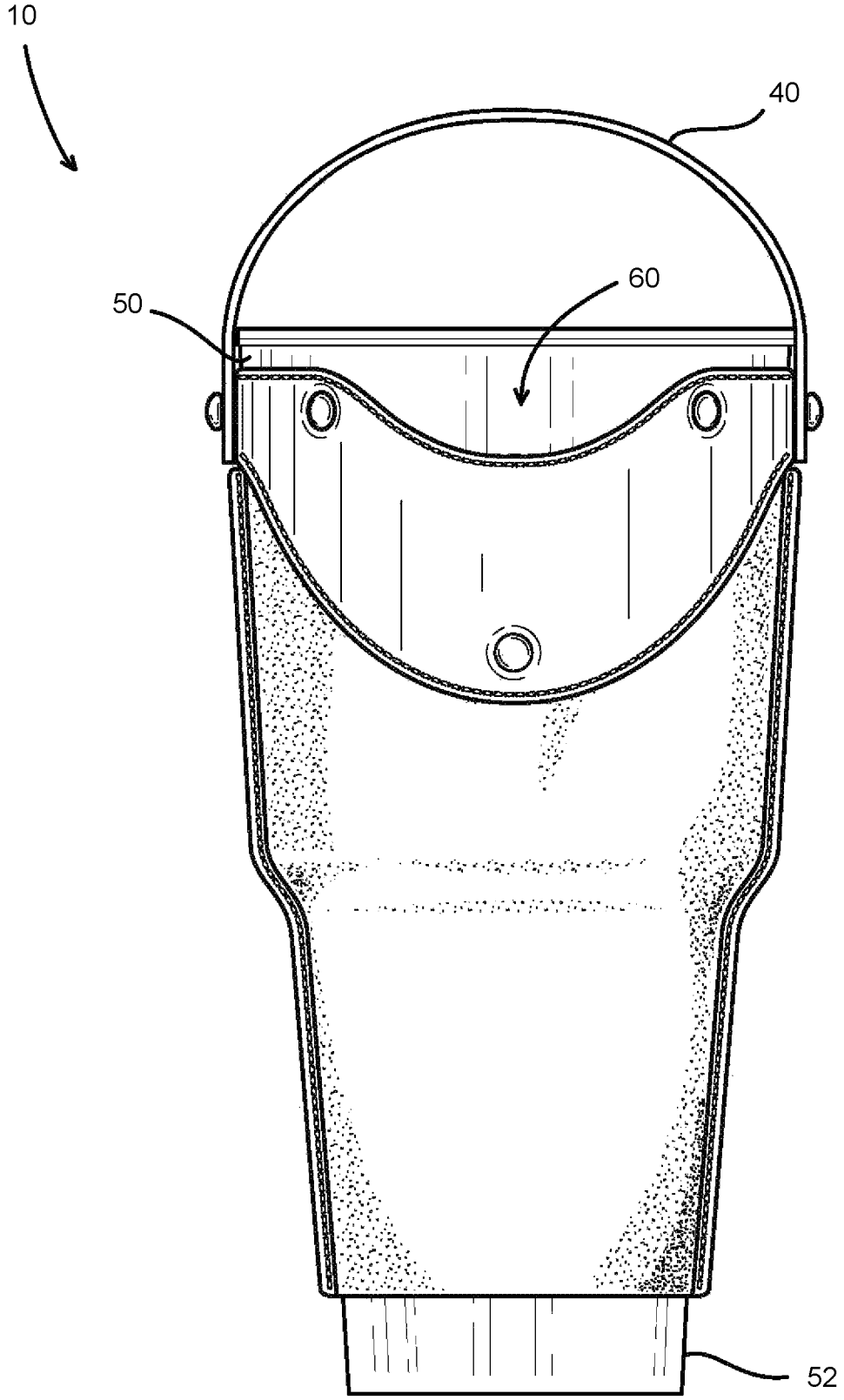
FIG. 12 is a front view of an exemplary embodiment of a tumbler apparatus having a beverage container or tumbler positioned in a tumbler sleeve.
Figure 13:
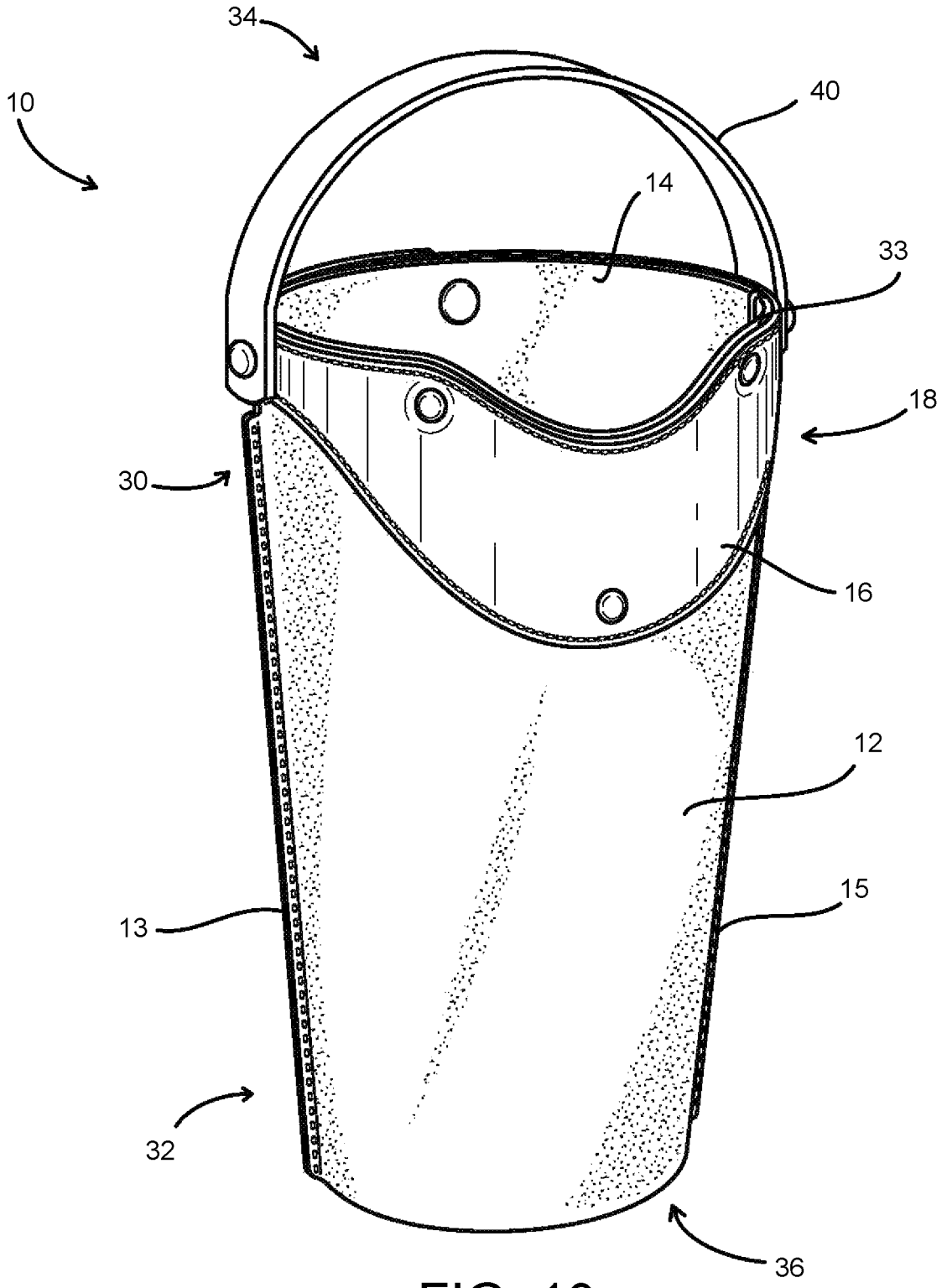
FIG. 13 is a perspective view of an alternative exemplary embodiment of a tumbler sleeve.
Figure 14:
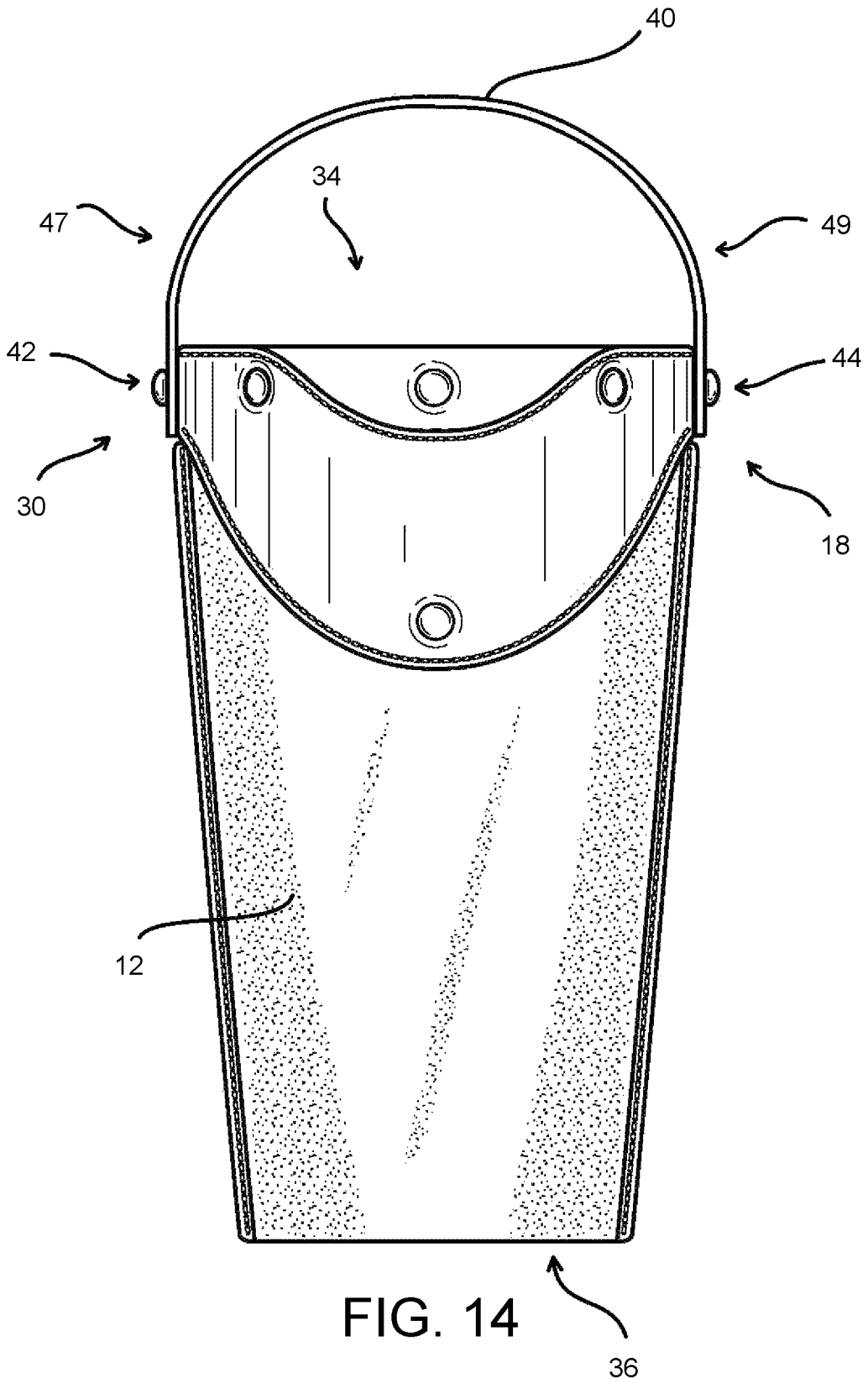
FIG. 14 is a front view of an alternative exemplary embodiment of a tumbler sleeve.
Figure 15:
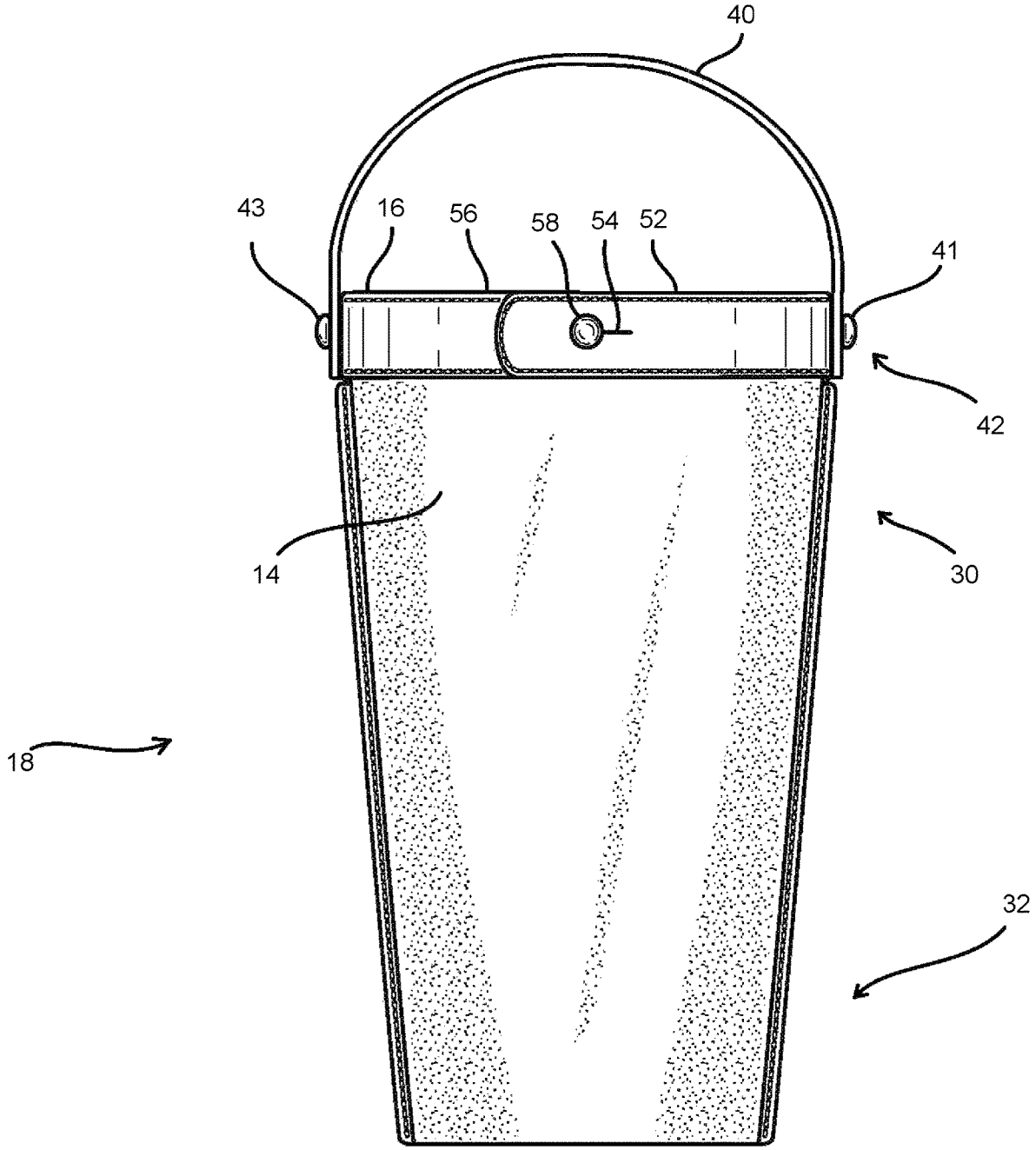
FIG. 15 is a back view of an alternative exemplary embodiment of a tumbler sleeve.
Figure 16:
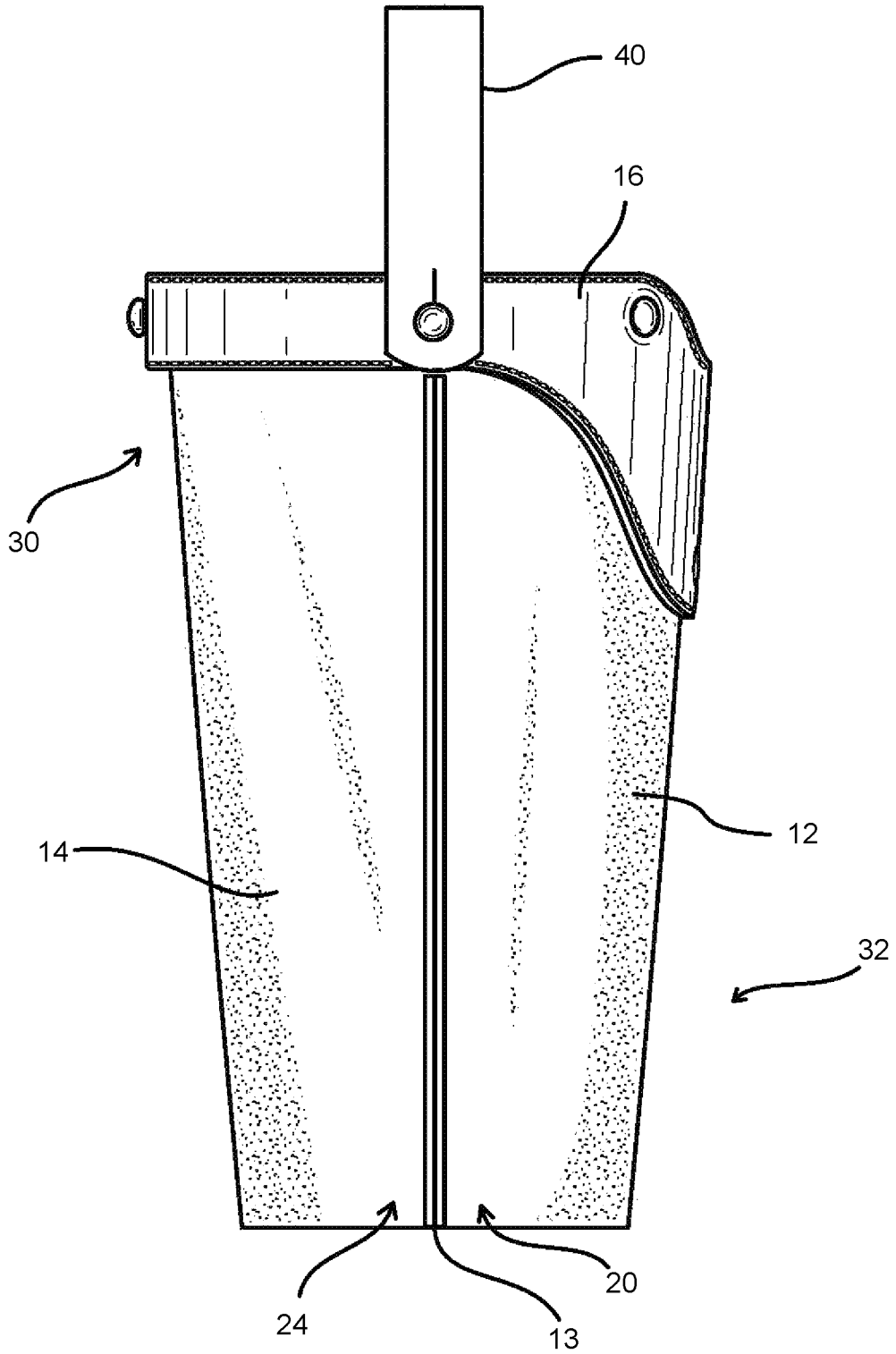
FIG. 16 is a first side view of an alternative exemplary embodiment of a tumbler sleeve.
Figure 17:
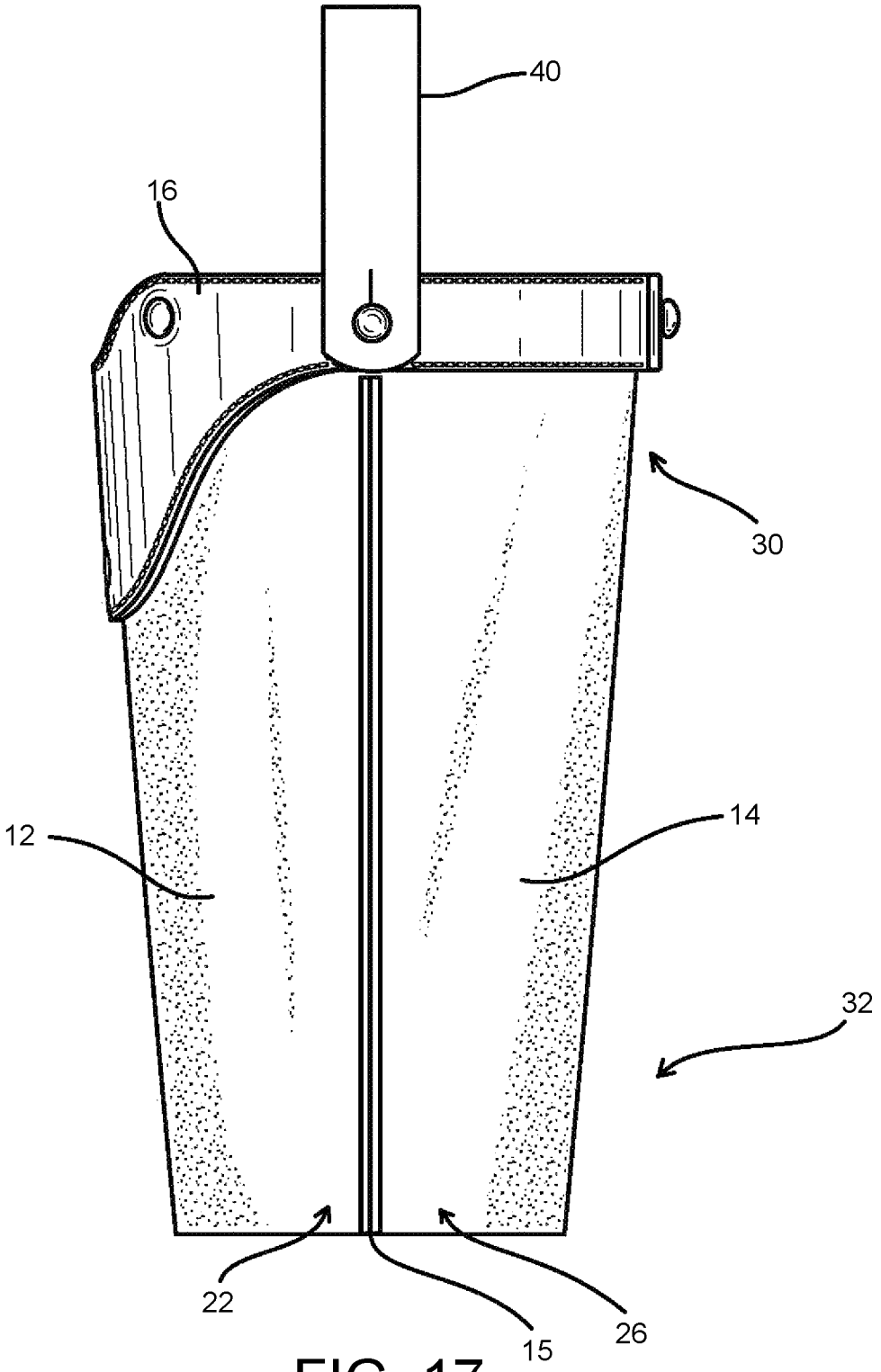
FIG. 17 is a second side view of an alternative exemplary embodiment of a tumbler sleeve.
Figure 18:
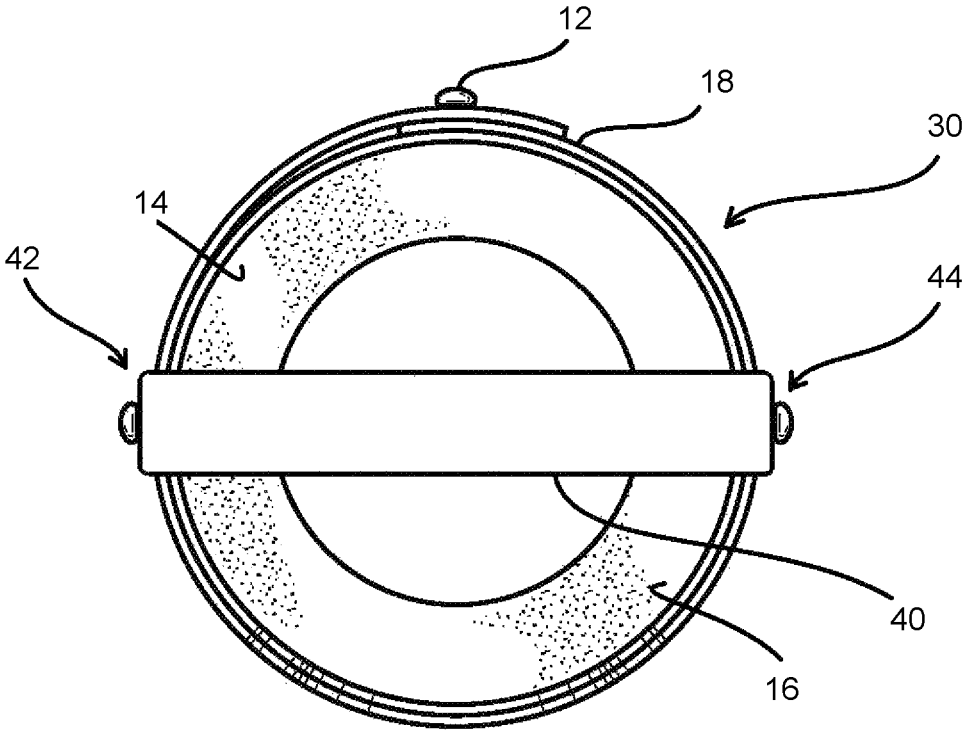
FIG. 18 is a top view of an alternative exemplary embodiment of a tumbler sleeve.
Figure 19:
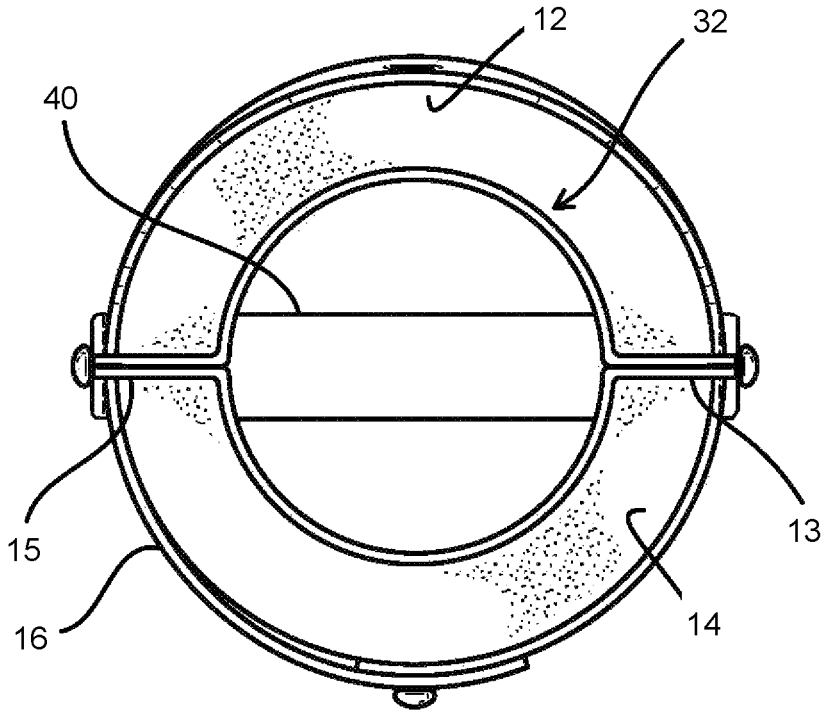
FIG. 19 is a bottom view of an alternative exemplary embodiment of a tumbler sleeve.
Figure 20:
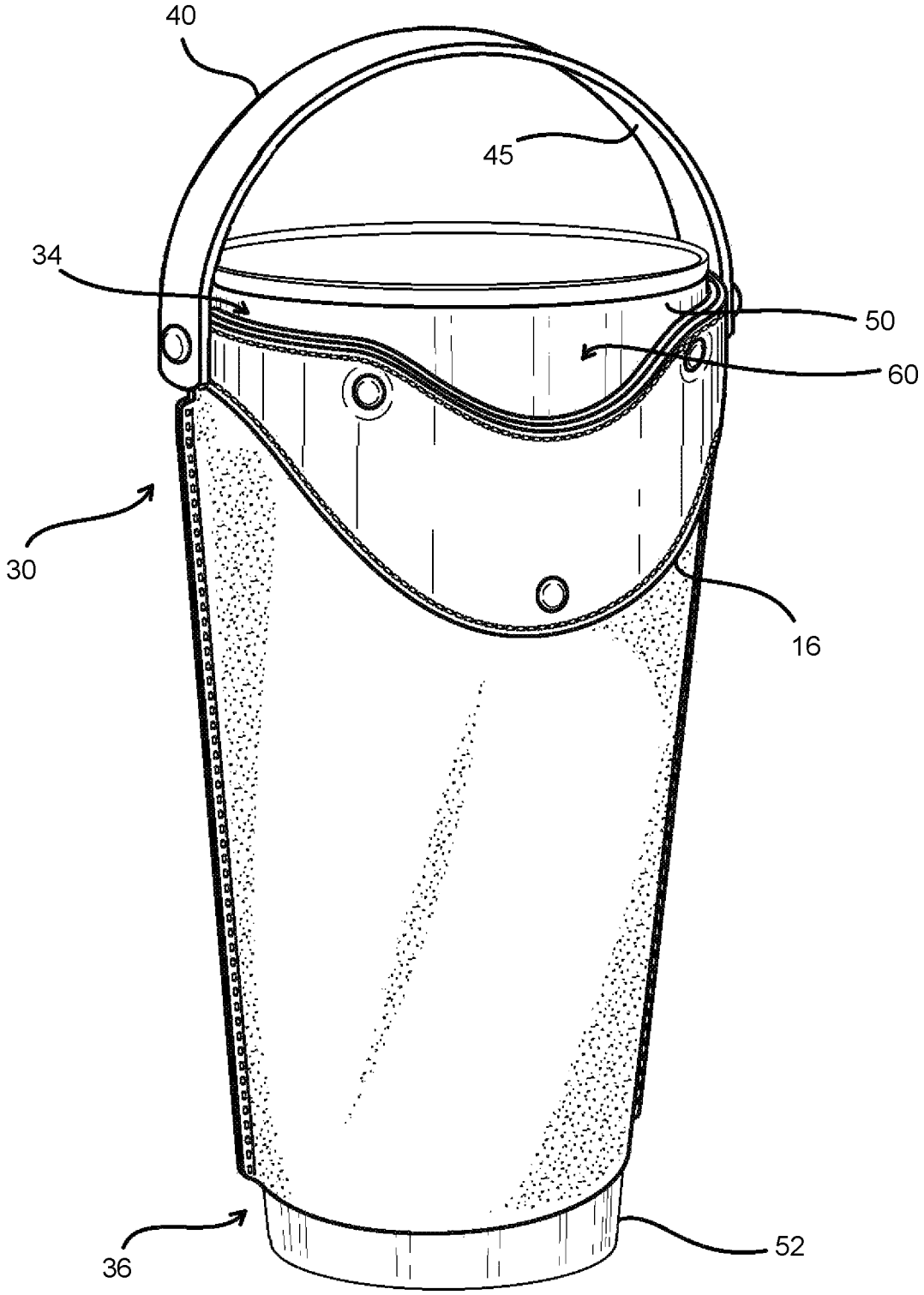
FIG. 20 is a perspective view of an alternative exemplary embodiment of a tumbler apparatus having a beverage container or tumbler positioned in a tumbler sleeve.
Figure 21:
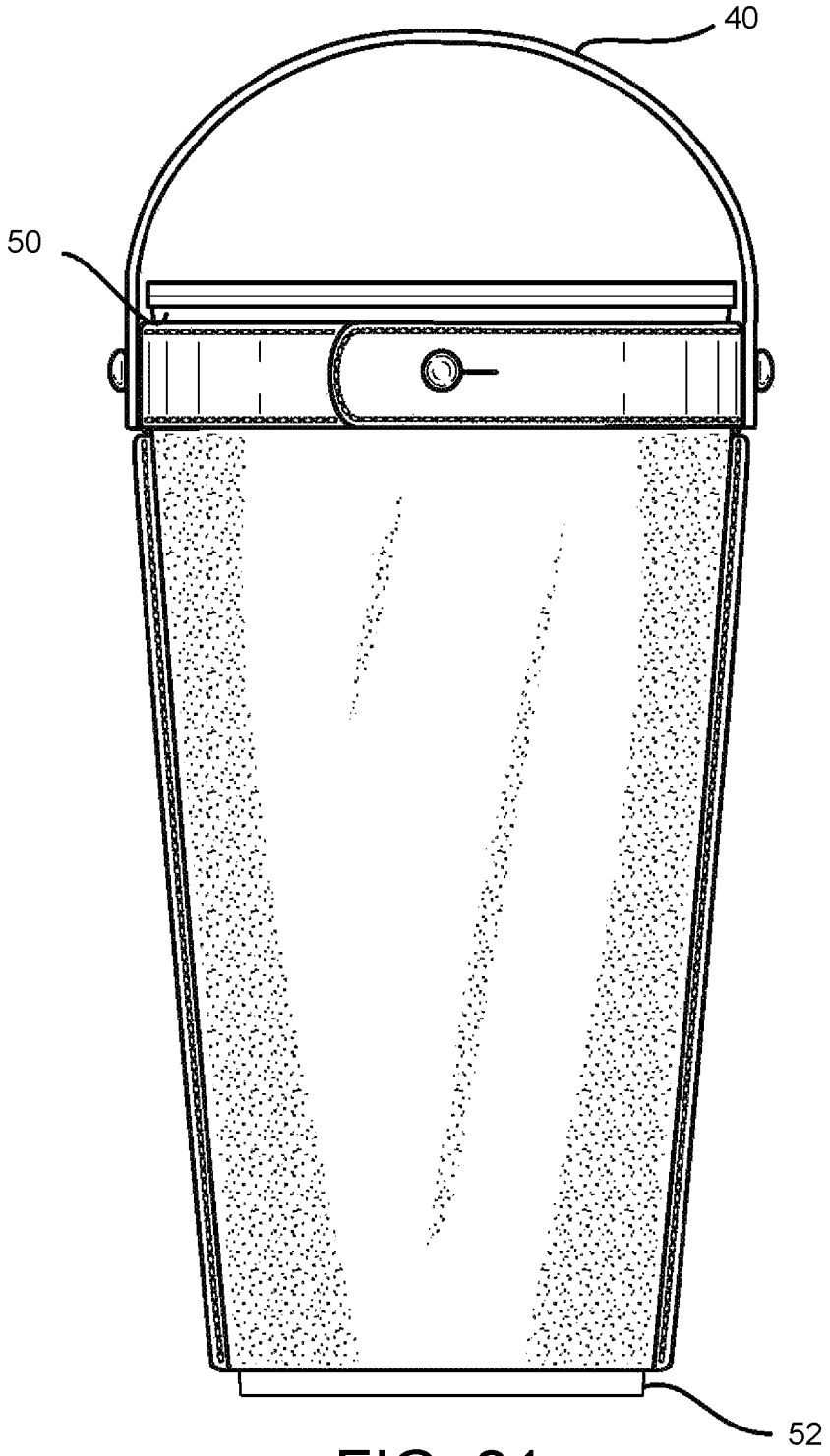
FIG. 21 is a back view of an alternative exemplary embodiment of a tumbler apparatus having a beverage container or tumbler positioned in a tumbler sleeve.

FIGS. 11 and 12 demonstrate exemplary embodiments of a tumbler apparatus 10, wherein the sleeve 18 receives a tumbler or a beverage container 50. The tumbler 50 may be inserted into the tumbler sleeve 18 via the upper opening 34. The inner diameter of the sleeve 18 (or in other measurements, the upper circumference) at the upper end 30 may be dimensioned such that it is equal to or slightly smaller than the outer diameter of the tumbler 50 at an upper end of the tumbler 50. This allows the tumbler 50 to be received by the sleeve 18 in a friction or interference fit. Thus, when the sleeve 18 has a lower opening 36, the tumbler 50 does not pass through the sleeve 18. The lower end 32 may have a lower circumference that is less than the upper circumference of the upper end 30 of the sleeve 18. The profile of the inner surface of the sleeve 18 may match that of the profile of a tumbler 50 such that the entire inner surface of the sleeve 18 may be in friction or interference fit engagement with the tumbler. The inner surface of the sleeve 18 may comprise the anterior surface of the first panel 12 and the anterior surface of the second panel 14 (or in those embodiments in which there is a single panel, the anterior surface of the first panel 12). The inner surface of the sleeve 18 may be textured in order to provide a better friction fit between the tumbler 50 and the tumbler sleeve 18. In one embodiment, the inner surface of the sleeve 18 may be an untreated, unfinished, raw, or roughed up surface of a leather panel. However, the apparatus 10 is not limited to any single material or combinations of materials, and one of ordinary skill in the art will recognize that a variety of materials and manufacturing techniques may be used with regards to the present disclosure.

The sleeve 18 may be dimensioned such that the lower opening 36 may allow a lower portion or base 52 of the tumbler 50 to be exposed. Thus, when the tumbler sleeve 18 has received the tumbler 50, the tumbler 50 may still directly contact a surface when the tumbler 50 is placed on that surface. This allows the tumbler 50 to maintain a stable base and stable contact with a surface such as a table or the ground. The first panel 12 and the second panel 14 may be dimensioned such that only a small portion of the base 52 of the tumbler may be exposed when the tumbler 50 is received by the tumbler sleeve 18, or a large portion may be exposed in other embodiments. In order for a portion of the tumbler 50 to be exposed, in some embodiments the diameter of the inside surface of the lower opening 36 of the sleeve 18 is equal to or slightly larger than the outer diameter of the tumbler 50 at a lower portion 52 of the tumbler 50, which allows the lower portion 52 of the tumbler 50 to extend through the lower opening 36. This allows the sleeve 18 to maintain a friction fit with the tumbler 50. With a lower portion 52 of the tumbler 50 exposed through the lower opening 36 of the sleeve 18, a user may use the lower opening 36 to remove the tumbler 50 from the sleeve 18 by applying force to the tumbler 50 at the lower opening 36 and pushing the tumbler 50 up through the upper opening 34.

Referring again to FIG. 11, the tumbler apparatus 10 may include a recess 60 on the sleeve 18. The recess 60 may provide access to an outer surface of the tumbler 50 when the tumbler 50 is seated in the tumbler sleeve 18. The recess 60 may include a recessed portion extending into the body 17 of the third panel 16. In some embodiments, the recess 60 may include a portion extending into the first panel 12. In other embodiments, the recess 60 may extend into the first panel 12 and the body 17 of the third panel 16. In some embodiments, the recess 60 permits a user to drink from the tumbler without contacting the tumbler sleeve 18 with his or her lips. Likewise, the recess 60 may allow a user to grasp the tumbler 50 when the tumbler 50 is in a friction fit with the tumbler sleeve 18 and remove the tumbler 50 from the tumbler sleeve 18. The recess 60 may be positioned at the first opening 34 such that an upper perimeter of the sleeve 18 is not level.

Figure 10:
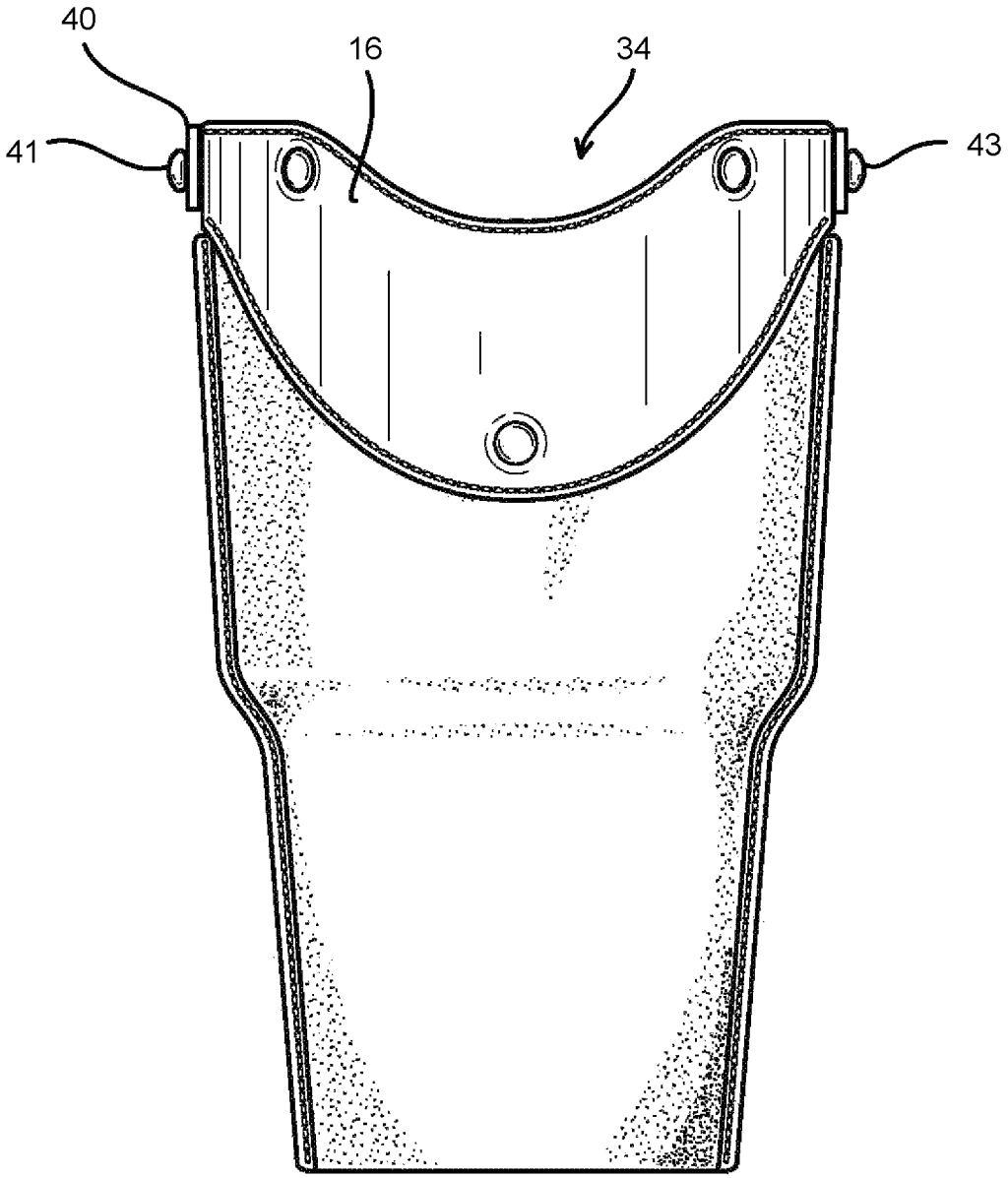
FIG. 10 is a front view of an exemplary embodiment of a tumbler sleeve having two recesses at the upper end of the tumbler sleeve and the handle rotated away from the upper opening.

In an alternative embodiment as seen in FIGS. 9 and 10, the sleeve 18 may include a recess 34 in the first panel 12 and at least a second recess in the second panel 14, such that a user may grasp a tumbler 50 positioned in the sleeve 18. This allows easier access for removing a tumbler 18 for cleaning, filling, or any other purpose.

FIGS. 13-21 provide an alternate embodiment in which the sleeve 18 is shaped to receive a tumbler 50 having a different outer profile compared to previous embodiments. However, any of the alterations to the sleeve 18 as shown and described with reference to FIGS. 1-12 may likewise be implemented in this alternate embodiment.

In some embodiments, the first panel 12, the second panel, 14, the third panel 16, and the handle 40 may comprise leather. In other embodiments, the first panel 12, the second panel, 14, the third panel 16, and the handle 40 may comprise any suitable material available to one of skill in the art including fabrics, plastics, etc. In some embodiment, the body 17 of the third panel 16 provides a space, which may be customized, including engravings, initials, stickers, etc.

Thus, although there have been described particular embodiments of the present invention of a new and useful TRAVELER LEATHER TUMBLER SLEEVE, it is not intended that such references be construed as limitations upon the scope of this invention.

What is claimed is:

1. A tumbler sleeve apparatus for holding a beverage container, comprising:

a first panel having a first anterior surface, a first posterior surface, a first lateral edge, and a second lateral edge;

a second panel having a second anterior surface, a second posterior surface, a third lateral edge coupled to the first lateral edge of the first panel, and a fourth lateral edge coupled to the second lateral edge of the first panel such that the first panel and second panel form a sleeve having an upper end and a lower end; and a third panel having a first end and a second end, the third panel coupled to the first panel, wherein the sleeve forms an upper opening and a lower opening, wherein the upper opening is configured to receive the beverage container, wherein the first posterior surface of the first panel and the second posterior surface of the second panel are configured to engage the beverage container in an interference fit when the beverage container is received by the sleeve, wherein the third panel includes a first extension and a second extension, and wherein the first extension includes a ball fastener and the second extension includes a slit operable to receive the ball fastener.

2. The tumbler sleeve apparatus of claim 1, wherein the third panel extends around the upper end of the sleeve when the first extension and the second extension are engaged via the ball fastener and slit.

3. The tumbler sleeve apparatus of claim 2, further comprising a handle extending from the upper end of the sleeve.

4. The tumbler sleeve apparatus of claim 3, wherein the handle is rotatable relative to the sleeve.

5. A tumbler sleeve apparatus for holding a beverage container, comprising:

a first panel having a first anterior surface, a first posterior surface, a first lateral edge, and a second lateral edge;

a second panel having a second anterior surface, a second posterior surface, a third lateral edge coupled to the first lateral edge of the first panel, and a fourth lateral edge coupled to the second lateral edge of the first panel such that the first panel and second panel form a sleeve having an upper end with an upper end circumference and a lower end with a lower end circumference; and a handle coupled to the upper end of the sleeve in a rotatable engagement, wherein the sleeve forms an upper opening configured to receive the beverage container, and wherein the handle is configured to span the upper opening, and wherein the handle is coupled to the upper end of the sleeve in the rotatable engagement via a ball and slit engagement.

6. A tumbler sleeve apparatus for holding a beverage container, comprising:

a first panel having a first anterior surface, a first posterior surface, a first lateral edge, and a second lateral edge;

a second panel having a second anterior surface, a second posterior surface, a third lateral edge coupled to the first lateral edge of the first panel, and a fourth lateral edge coupled to the second lateral edge of the first panel such that the first panel and second panel form a sleeve having an upper end and a lower end;

a third panel coupled to the first panel; and a handle coupled to the upper end of the sleeve in a rotatable engagement, wherein the sleeve forms an upper opening configured to receive the beverage container, and wherein the handle is configured to span the upper opening, wherein the third panel includes a first extension and a second extension, and wherein the first extension includes a ball fastener and the second extension includes a slit operable to receive the ball fastener.

7. The tumbler sleeve apparatus of claim 6, wherein the third panel extends around the upper end of the sleeve when the first extension and the second extension are engaged via the ball fastener and slit.

8. A drinking apparatus, comprising:

a beverage container having an outer surface, an upper container end, and a lower container end; and a beverage container sleeve having a first panel and a second panel coupled at lateral ends of the first and second panels and a third panel coupled to the first panel and extending around the first and second panels, wherein the first panel and the second panel form an interior receiver with an open upper end and an open lower end, wherein the beverage container is positioned in the beverage container sleeve, and wherein the upper container end extends out of the open upper end of the beverage container sleeve and the lower container end extends out of the open lower end of the beverage container sleeve.

9. The drinking apparatus of claim 8, wherein the outer surface of the beverage container is in an interference fit with the beverage container sleeve.

10. The drinking apparatus of claim 9, wherein the beverage container sleeve further comprises a handle coupled to the first and second panels in a rotatable engagement proximate the open upper end.

11. The drinking apparatus of claim 10, wherein the handle spans the open upper end.

12. The drinking apparatus of claim 8, wherein the third panel includes a first extension and a second extension, and wherein the first extension includes a ball fastener and the second extension includes a slit operable to receive the ball fastener.

* * * * *